US010131490B2

(12) United States Patent
D'Alfonso et al.

(10) Patent No.: US 10,131,490 B2
(45) Date of Patent: Nov. 20, 2018

(54) RIGID, SWING-OPEN PACKAGE OF TOBACCO ARTICLES

(71) Applicant: G.D SOCIETA' PER AZIONI, Bologna (IT)

(72) Inventors: Lorena D'Alfonso, Lettomappello (IT); Stefano Negrini, Calderara di Reno (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 301 days.

(21) Appl. No.: 15/111,834

(22) PCT Filed: Jan. 15, 2015

(86) PCT No.: PCT/IB2015/050309

§ 371 (c)(1),
(2) Date: Jul. 15, 2016

(87) PCT Pub. No.: WO2015/107478

PCT Pub. Date: Jul. 23, 2015

(65) Prior Publication Data

US 2016/0332802 A1 Nov. 17, 2016

(30) Foreign Application Priority Data

Jan. 15, 2014 (IT) ..... BO2014A0009

(51) Int. Cl.

| | |
|---|---|
| ***B65D 85/10*** | (2006.01) |
| ***B65D 5/72*** | (2006.01) |
| ***B65D 5/18*** | (2006.01) |
| ***B65D 5/42*** | (2006.01) |

(Continued)

(52) U.S. Cl.

CPC ..... *B65D 85/1045* (2013.01); *B65D 5/18* (2013.01); *B65D 5/4266* (2013.01); *B65D 5/721* (2013.01); *B65D 85/1036* (2013.01)

(58) Field of Classification Search

CPC ..... B65D 85/00; B65D 85/07; B65D 85/08; B65D 85/10; B65D 85/1036;

(Continued)

(56) References Cited

U.S. PATENT DOCUMENTS

2007/0146142 A1* 6/2007 Cote ..... B65D 85/10 340/572.8
2007/0193895 A1* 8/2007 Weiss ..... A24F 15/12 206/259

(Continued)

FOREIGN PATENT DOCUMENTS

WO WO-03/53818 A1 7/2003
WO WO-2006/061563 A1 6/2006

(Continued)

OTHER PUBLICATIONS

International Search Report and Written Opinion, International Application No. PCT/IB2015/050309, dated Apr. 9, 2015.

(Continued)

*Primary Examiner* — Steven A. Reynolds
*Assistant Examiner* — Javier A Pagan
(74) *Attorney, Agent, or Firm* — Marshall, Gerstein & Borun LLP

(57) ABSTRACT

A rigid, swing-open package of tobacco articles having: a group of tobacco articles; an inner container housing the group of tobacco articles; an outer container housing the inner container; a main hinge connecting the inner container to the outer container to allow the inner container to rotate between a closed position and an open position; and a stop member, which limits extraction of the inner container from the outer container and so defines a fully-open position of the inner container with respect to the outer container; the stop member being provided with a stop tab having an inner panel hinged at one end to the inner container, an outer panel (Continued)

glued to a wall of the outer container, and an intermediate panel hinged to the inner panel on one side and to the outer panel on the opposite side.

16 Claims, 39 Drawing Sheets

(58) Field of Classification Search
CPC ..... B65D 85/1045; B65D 85/1054; B65D 85/1063; B65D 85/1072; B65D 85/12; B65D 5/18; B65D 5/4266; B65D 5/427; B65D 5/72; B65D 5/721
USPC ..... 206/261, 242, 262, 263
See application file for complete search history.

(56) References Cited

U.S. PATENT DOCUMENTS

2007/0246383 A1* 10/2007 He ..... B65D 7/06 206/268
2011/0114103 A1* 5/2011 Hirai ..... A24F 47/00 131/271
2015/0034507 A1* 2/2015 Liu ..... A24F 15/12 206/256
2016/0090230 A1* 3/2016 Dong ..... B65D 85/1045 206/246
2017/0349338 A1* 12/2017 Ziering ..... B65D 43/22

FOREIGN PATENT DOCUMENTS

WO WO 2006061563 A1 * 6/2006 ..... B65D 5/5213
WO WO-2009/010851 A2 1/2009
WO WO 2009010851 A2 * 1/2009 ..... B65D 5/5213
WO WO-2010/069672 A1 6/2010
WO WO 2010069672 A1 * 6/2010 ..... B65D 5/5213
WO WO-2013/144921 A1 10/2013
WO WO 2013144921 A1 * 10/2013 ..... B65D 85/1054
WO WO-2013/167938 A1 11/2013
WO WO 2013167938 A1 * 11/2013 ..... B65D 85/1036

OTHER PUBLICATIONS

International Preliminary Report on Patentability, International Application No. PCT/IB2015/050309, dated Jan. 20, 2016.

* cited by examiner

RIGID, SWING-OPEN PACKAGE OF TOBACCO ARTICLES

CROSS-REFERENCE TO RELATED APPLICATIONS

This application is the U.S. National Phase of PCT/IB2015/050309, filed Jan 15, 2015, which claims the benefit of Italian Patent application No. B02014A000009,filed Jan 15, 2014.

TECHNICAL FIELD

The present invention relates to a rigid, swing-open package of tobacco articles.

The present invention is advantageously applicable to a cigarette packet, to which the following description will make explicit reference, without any loss of generality.

PRIOR ART

Patent applications WO03053818-A1, WO2009010851-A2 and WO2013144921-A1 describe a rigid, swing-open cigarette packet comprising two containers, with one inserted in the other in a partially separable manner. In particular, an inner container is provided that accommodates a group of wrapped cigarettes and is housed inside an outer container such that it can be moved, with respect to the outer container and by means of a rotary movement about a main hinge, between a closed position, in which the inner container is inserted inside the outer container, and an open position, in which the inner container is partly extracted from the outer container; the inner container can be provided with a hinged lid that is mechanically constrained to the outer container by specially provided retention elements to 'automatically' open and close the lid (i.e. without the user having to touch the lid) due to the effect of the movement of the inner container with respect to the outer container.

The swing-open cigarette packet is provided with a stop member, which limits extraction of the inner container from the outer container and therefore defines a maximum opening position of the inner container with respect to the outer container. In known cigarette packets, the stop member that limits extraction of the inner container from the outer container comprises a pair of stop tabs, which project outwards from the inner container (from the lateral walls of the inner container) and are located near the rear wall of the inner container; furthermore, the stop member comprises a pair of stop pockets, which project inwards from the outer container, (from the lateral walls of the outer container) and are located near the open end of the outer container. In use, when the inner container rotates with respect to the outer container about the main hinge from the closed position to the open position, each stop tab enters a respective stop pocket until it causes the extraction movement of the inner container to stop.

However, known stop members of the above type are not entirely effective, as it is possible that a stop tab does not correctly enter the corresponding stop pocket.

DESCRIPTION OF INVENTION

The object of the present invention is to provide a rigid, swing-open package of tobacco articles that does not have the above-described drawbacks and, in particular, is simple and inexpensive to produce.

According to the present invention, a rigid, swing-open package of tobacco articles is provided according to that claimed in appended claims.

BRIEF DESCRIPTION OF DRAWINGS

The present invention will now be described with reference to the attached drawings, in which.

PREFERRED EMBODIMENTS OF THE INVENTION

Figure 1:
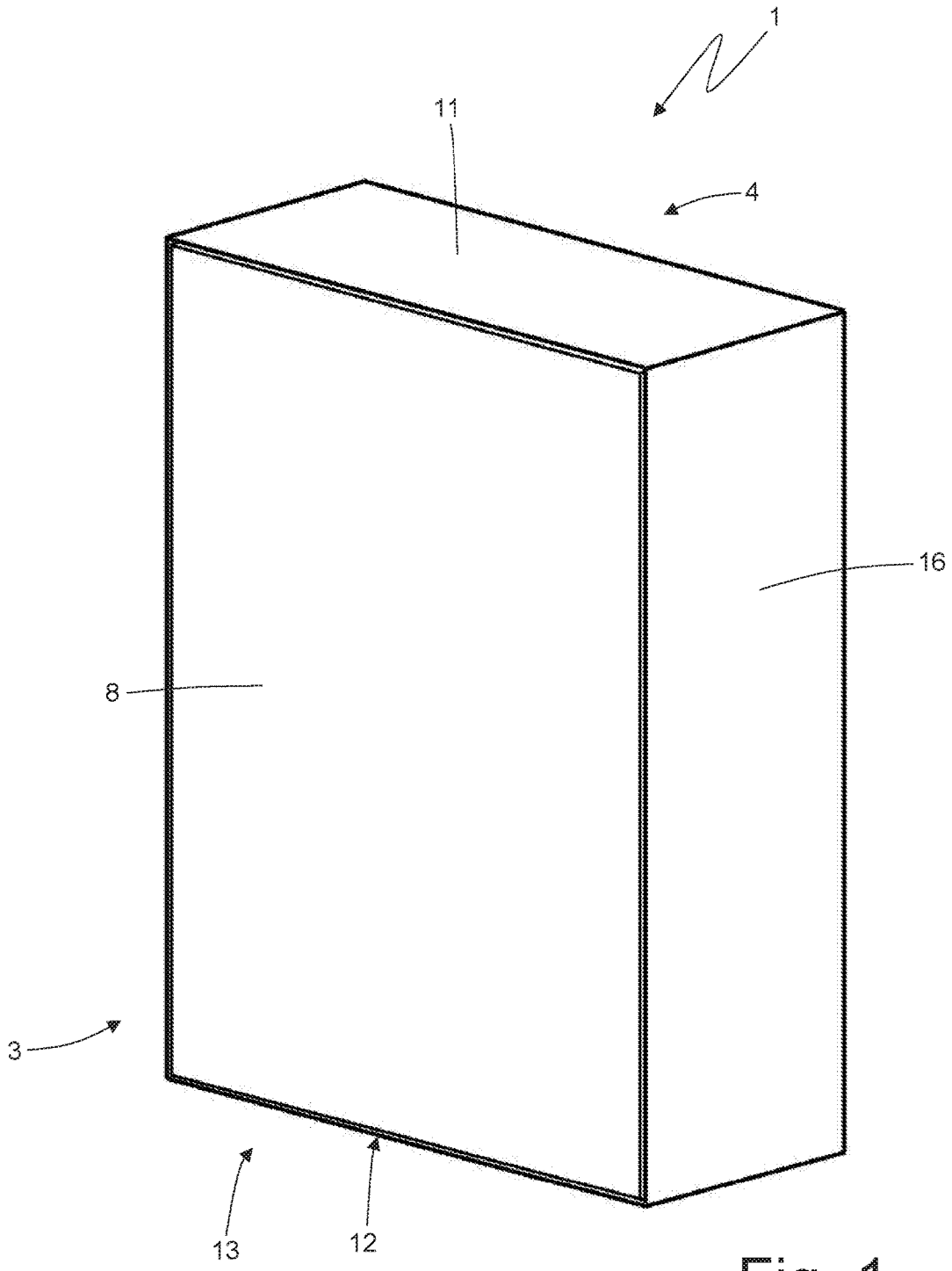
FIG. 1 is a front perspective view of a rigid, swing-open cigarette packet arranged in a closed configuration.
Figure 2:
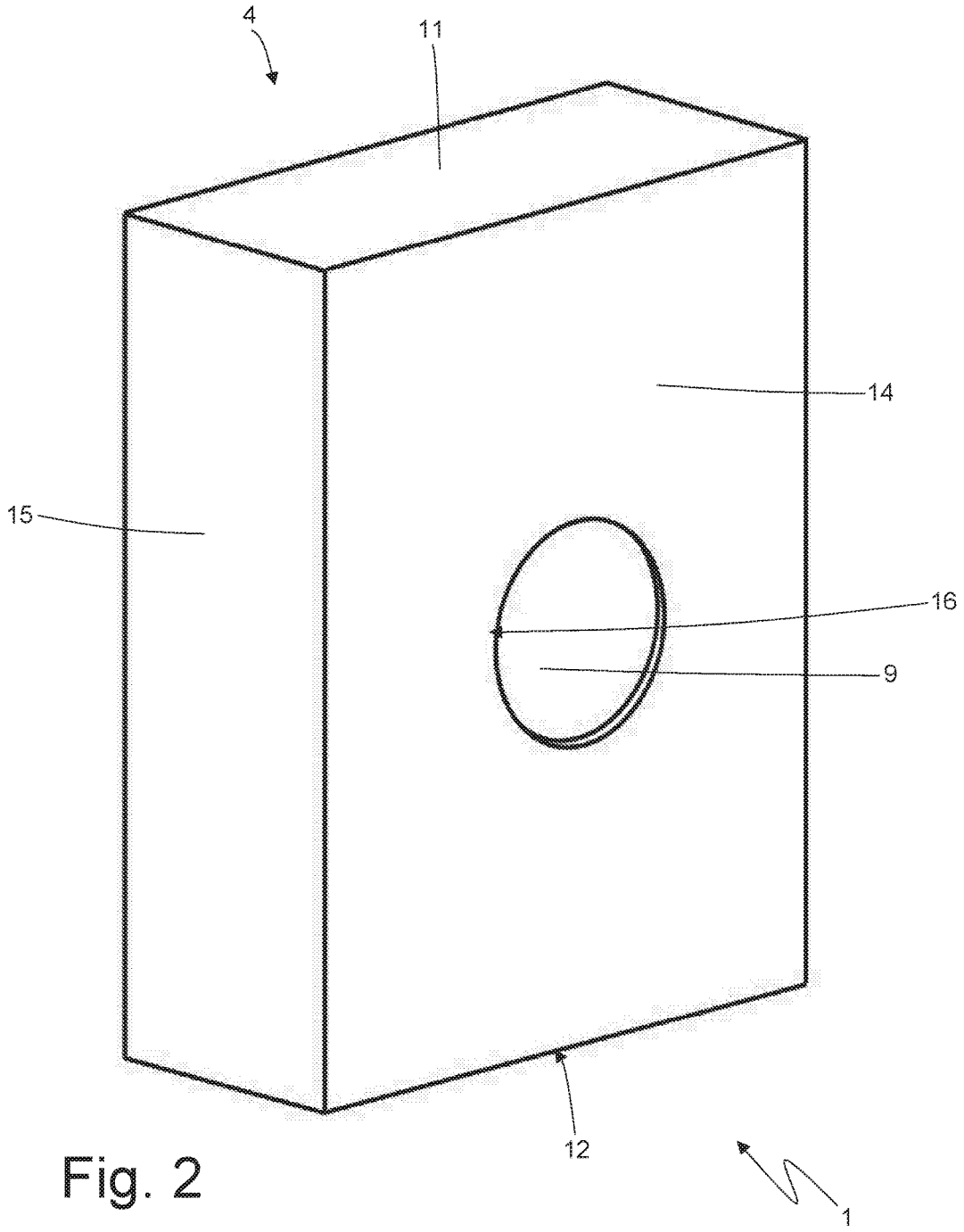
FIG. 2 is a rear perspective view of the cigarette packet in FIG. 1 in a closed configuration.
Figure 3:
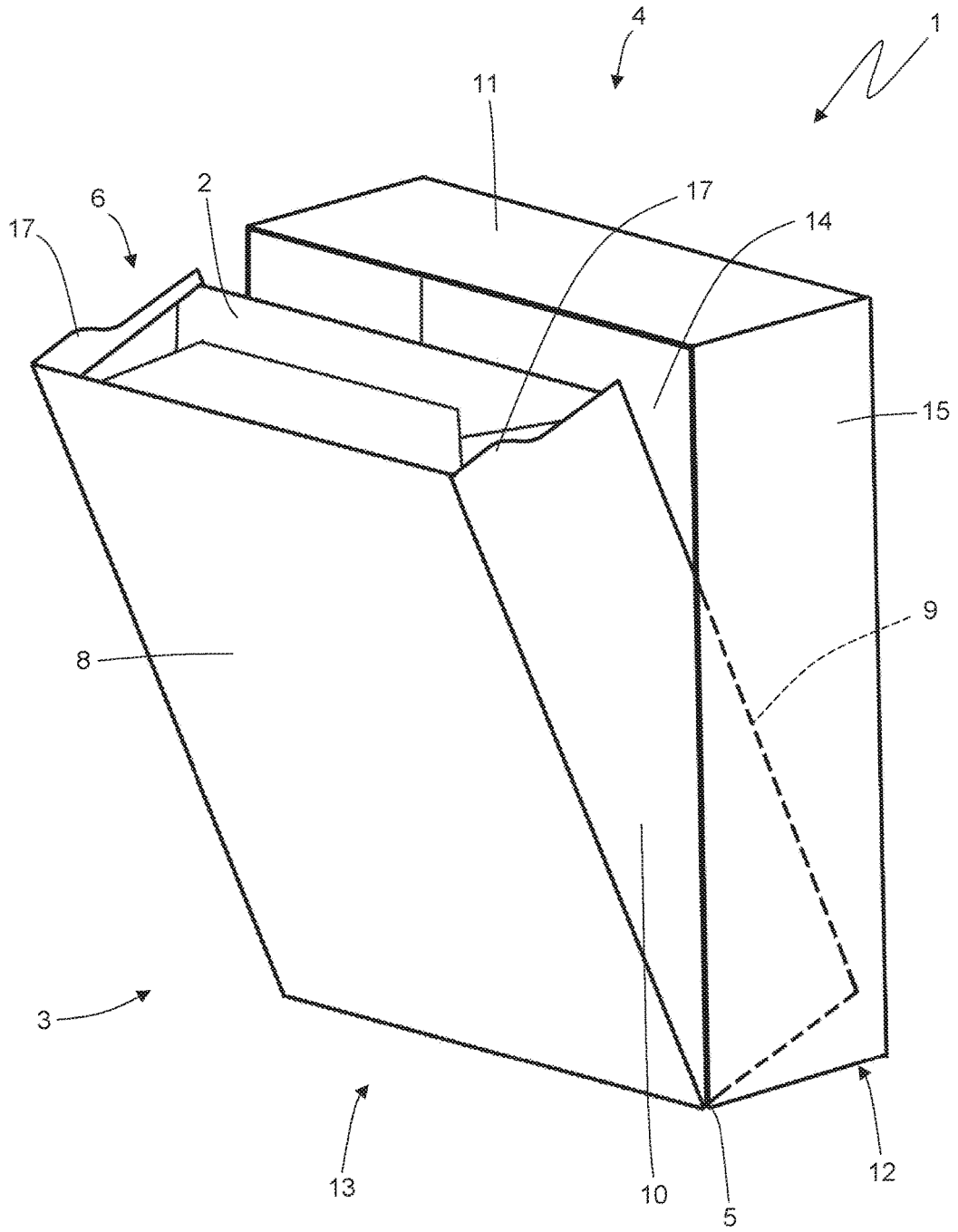
FIG. 3 is a front perspective view of the cigarette packet in FIG. 1 in an open configuration.

In FIGS. 1, 2 and 3, reference numeral 1 indicates, as a whole, a rigid, swing-open cigarette packet.

The cigarette packet 1 comprises a wrapped group 2 of cigarettes (partially shown in FIG. 2) composed of a group of cigarettes and a wrapping sheet of metalized paper wrapped around the group of cigarettes to completely contain the group of cigarettes therein. The wrapping sheet normally has a line, pre-weakened by perforation, which delimits a removable upper portion that can be pulled off to open the wrapper and so allow subsequent extraction of the individual cigarettes.

In addition, the cigarette packet 1 comprises a rigid parallelepipedal inner container 3 that houses the wrapped group 2 of cigarettes and a rigid parallelepipedal outer container 4 that houses the inner container 3. The inner container 3 is hinged to the outer container 4 along a main hinge 5 to rotate with respect to the outer container 4 between a closed position (shown in FIG. 1), in which the inner container 3 is inserted inside the outer container 4, and an open position (shown in FIG. 2), in which the inner container 3 is partially extracted from the outer container 4 to provide access to the wrapped group 2 of cigarettes.

The inner container 3 is parallelepipedal, with a receptacle-like shape and an open top end 6 through which the wrapped group 2 of cigarettes are accessed, a front wall 8, a rear wall 9 parallel and opposite to the front wall 8, and two lateral walls 10 parallel and opposite to each other.

The outer container 4 is also parallelepipedal and has a top wall 11, a bottom wall 12 that is parallel and opposite to the top wall 11, an open front end 13 through which the inner container 3 moves, a rear wall 14 that is opposite to the open front end 13 and parallel to and facing the rear wall 9 of the inner container 3 when the inner container 3 is in the closed position, and two lateral walls 15 that are parallel and opposite to each other and parallel to and facing the corresponding lateral walls 10 of the inner container 3 when the inner container 3 is in the closed position.

According to a preferred embodiment shown in FIG. 2, the rear wall 14 of the outer container 4 is provided with a through hole 16, which has a shape and size to allow a user's finger to pass through; to open the cigarette packet 1, a user holds the outer container 4 with one hand and inserts a finger of the other into the hole 16 to push onto the rear wall 9 of the inner container 3 so as to produce a relative movement between the inner container 3 and the outer container 4.

The cigarette packet 1 is provided with a retaining member that keeps the inner container 3 in the closed position (i.e. inside the outer container 4, as shown in FIGS. 1 and 2) with a given retaining force; to open the cigarette packet 1, or rather to move the inner container 3 from the closed position (shown in FIGS. 1 and 2) to the open position (shown in FIG. 3), it is necessary to overcome the retaining force generated by the retaining member, i.e. it is necessary to apply an opening force to the inner container 3 greater than the retaining force generated by the retaining member. The function of the retaining member is to keep the inner container 3 in the closed position when not in the user's hands to avoid undesired opening of the cigarette packet 1 (for example, when the cigarette packet 1 is placed inside a bag or in a pocket).

In the embodiment shown in FIG. 3, the retaining member comprises two retaining appendages 17 that project upwards from the lateral walls 10 of the inner container 3 (i.e. constituting a natural upwards continuation of the lateral walls 10 of the inner container 3). The retaining appendages 17 are sized to interfere mechanically with the top wall 11 of the outer container 4 when the inner container 3 is in the closed position (i.e. when it is inside the outer container 4 as shown in FIGS. 1 and 2); in other words, the retaining appendages 17 interfere with (frictionally rub against) the top wall 11 of the outer container 4 and therefore a slight elastic deformation (of both the retaining appendages 17 and the top wall 11) is necessary to allow extraction of the inner container 3 from the outer container 4. The interference of the retaining appendages 17 with the top wall 11 of the outer container 4 generates the retaining force that keeps the inner container 3 in the closed position (i.e. inside the outer container 4, as shown in FIGS. 1 and 2); in other words, the retaining appendages 17 press against the inner surface of the top wall 11 of the outer container 4 and therefore give rise to a frictional force between the retaining appendages 17 and the top wall 11, which constitutes the retaining force that keeps the inner container 3 in the closed position (i.e. inside the outer container 4, as shown in FIGS. 1 and 2).

Figure 4:
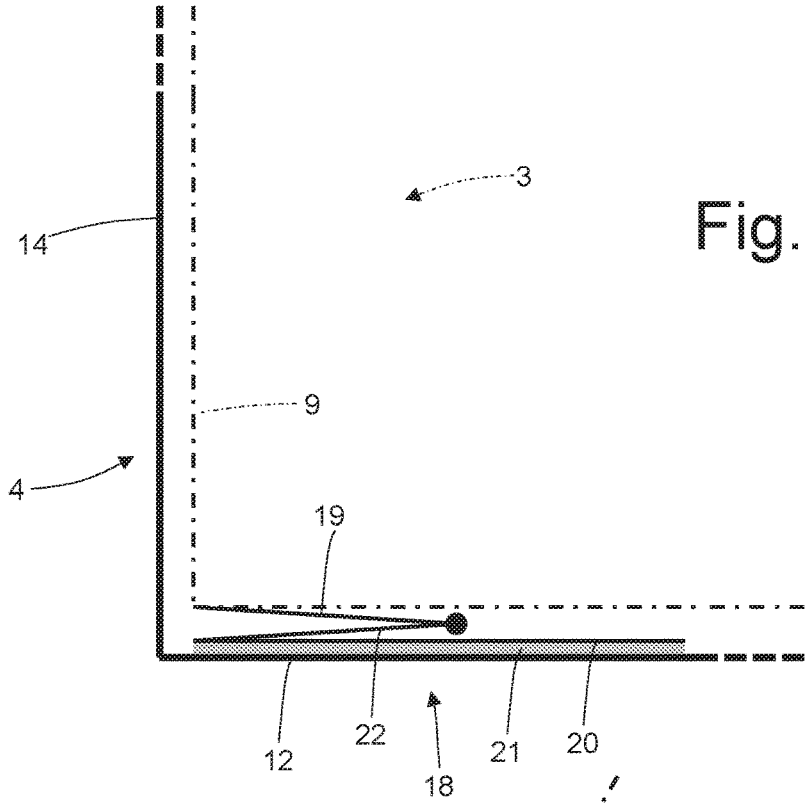
FIGS. 4 and 5 are two schematic views of a bottom part of the cigarette packet in FIG. 1 in a closed configuration and in an open configuration, respectively.
Figure 5:
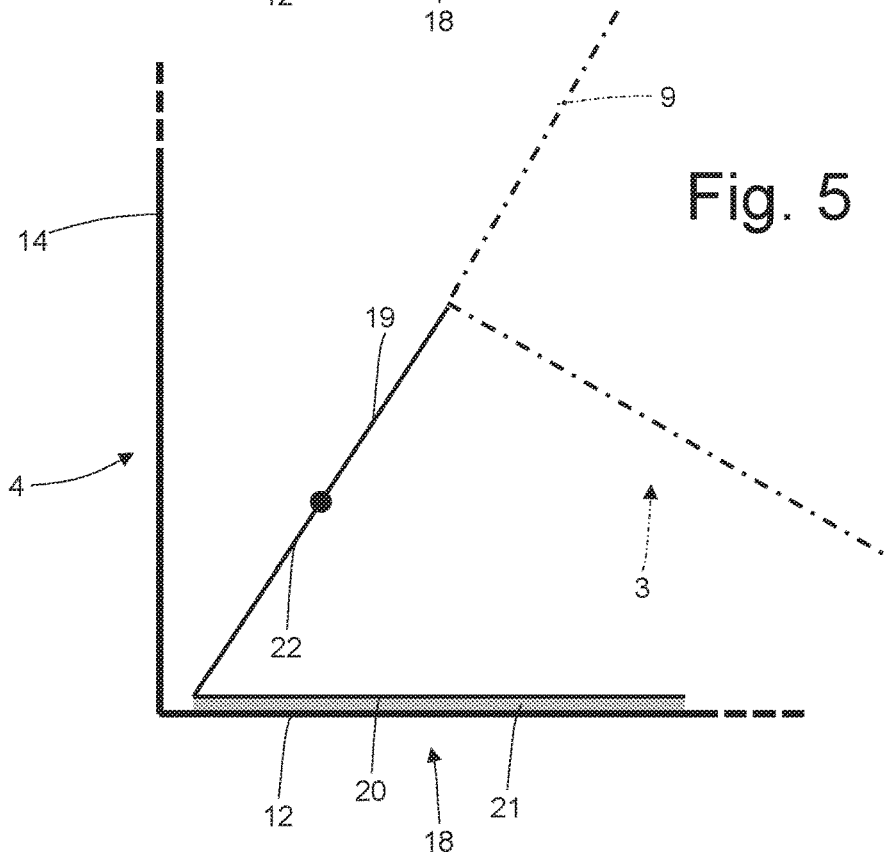

As shown in FIGS. 4 and 5, the cigarette packet 1 is provided with a stop member that limits extraction of the inner container 3 from the outer container 4 and so defines a fully-open position of the inner container 3 with respect to the outer container 4. The stop member comprises a single stop tab 18 (better shown in FIG. 10), which is located centrally, projecting outwards from the rear wall 9 of the inner container 3 and glued to the bottom wall 12 of the outer container 4. In particular, the stop tab 18 comprises an inner panel 19 with one end hinged to the bottom edge of the rear wall 9 of the inner container 3, an outer panel 20 that is glued to the bottom wall 12 of the outer container 4 by means of glue 21, and an intermediate panel 22 that is hinged to the inner panel 19 on one side and to the outer panel 20 on the opposite side.

When the cigarette packet 1 is in the closed position (shown in FIG. 4), the two panels 19 and 22 of the stop tab 18 are folded one on top of the other like a concertina, so that they are positioned between the inner container 3 and the bottom wall 12 of the outer container 4; as the inner container 3 is rotated with respect to the outer container 4 about the main hinge 5 (i.e. as the inner container 3 moves towards the open position) the two panels 19 and 22 of the stop tab 18 move apart until a limit position is reached in which the two panels 19 and 22 of the stop tab 18 are aligned with each other (as shown in FIG. 5) and therefore no longer allow the inner container 3 to move further away from the outer container 4 (i.e. the inner container 3 reaches the fully-open position, beyond which it cannot go).

Figure 6:
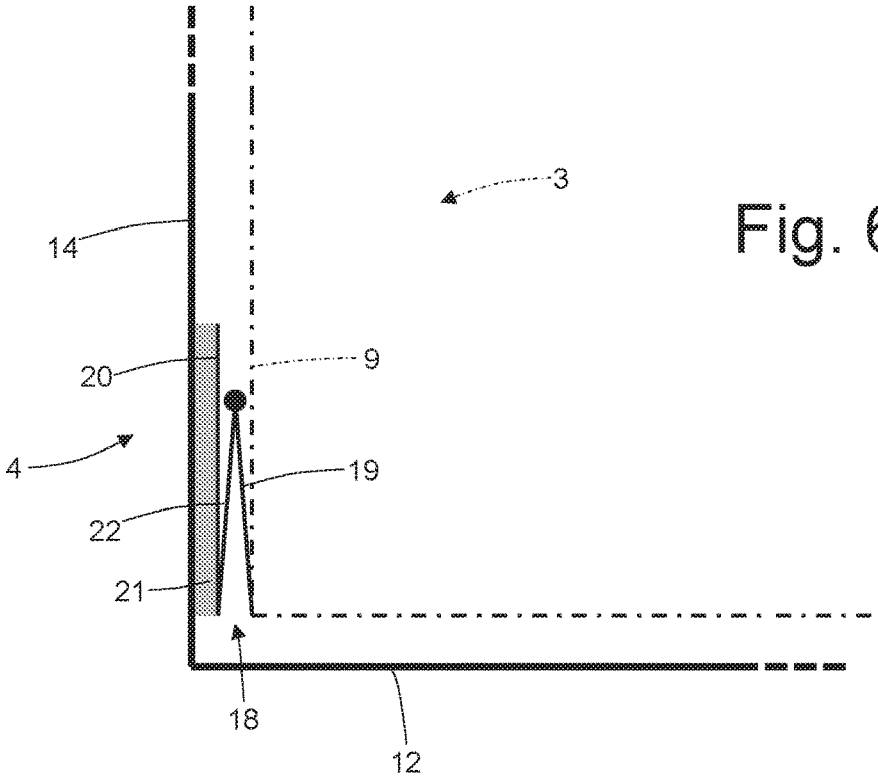
FIGS. 6 and 7 are two schematic views of a bottom part of a variant of the cigarette packet in FIG. 1 in a closed configuration and in an open configuration, respectively.
Figure 7:
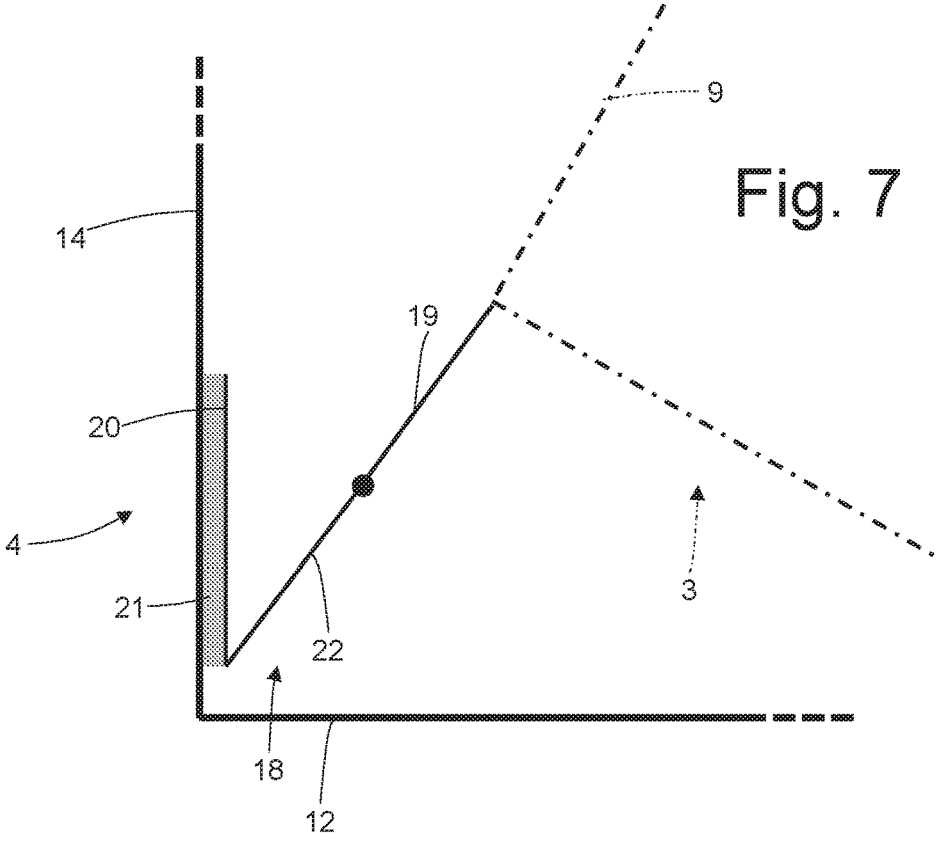

In the embodiment shown in FIGS. 6 and 7, the structure of the stop tab 18 remains unchanged, but the outer panel 20 is glued to the rear wall 14 of the outer container 4 instead of to the bottom wall 12 of the outer container 4. In other words, in the embodiment shown in FIGS. 6 and 7, the stop tab 18 is rotated 90° with respect to the embodiment shown in FIGS. 4 and 5, and therefore instead of being between the inner container 3 and the bottom wall 12 of the outer container 4, it is between the rear wall 9 of the inner container 3 and the rear wall 14 of the outer container 4.

Figure 8:
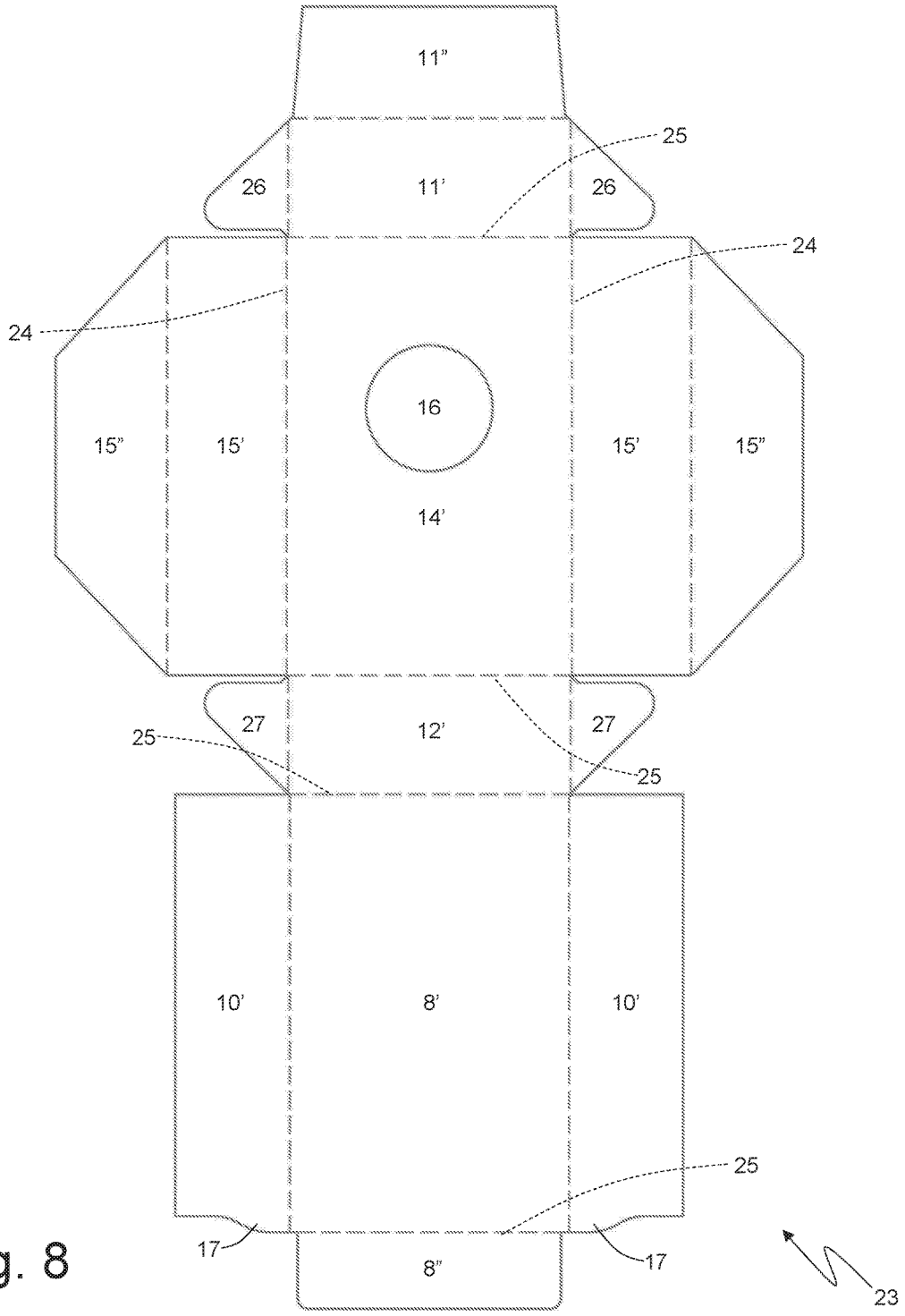
FIG. 8 is a plan view of a blank used to make an outer container and part of an inner container of the cigarette packet in FIG. 1.

As shown in FIG. 8, the outer container 4 is obtained by folding a flat, substantially oblong blank 23, the parts of which, where possible, are indicated with accented reference numerals equal to the reference numerals identifying the corresponding parts of the outer container 4.

The blank 23 has two longitudinal lines of weakness 24 and a plurality of transverse lines of weakness 25, which define, between the two longitudinal lines of weakness 24, a reinforcing panel 11" forming an internal reinforcement of the top wall 11 of the outer container 4, a panel 11' forming the top wall 11 of the outer container 4 and to the inside of which panel 11" is glued, a panel 14' forming the rear wall 14 of the outer container 4, a panel 12' forming the bottom wall 12 of the outer container 4, a panel 8' forming the front wall 8 of the inner container 3, and a reinforcing panel 8" forming an internal reinforcement of the front wall 8 of the inner container 3 and which is glued to the inside of panel 8'.

Panel 14' has a pair of wings 15' that form the lateral walls 15 of the outer container 4 and which are arranged on opposite sides of panel 14' and separated from panel 14' by longitudinal lines of weakness 24. In turn, wings 15' are fitted with further wings 15" that form internal reinforcements for the lateral walls 15 of the outer container 4 and are glued to the insides of wings 15'. Panel 8' has a pair of wings 10', which form an outer part of the lateral walls 10 of the inner container 3 and which are arranged on opposite sides of panel 8' and separated from panel 8' by longitudinal lines of weakness 24.

Panel 11' has a pair of tabs 26 that are folded 90° with respect to panel 11' and are glued to the insides of wings 15'. Panel 12' has a pair of tabs 27 that are folded 90° with respect to panel 12' and are glued to the insides of wings 15'.

The main hinge 5 that connects the inner container 3 to the outer container 4 is formed by the transverse line of weakness 25 that separates panel 8' forming the front wall 8 of the inner container 3 from panel 12' forming the bottom wall 12 of the outer container 4.

Figure 9:
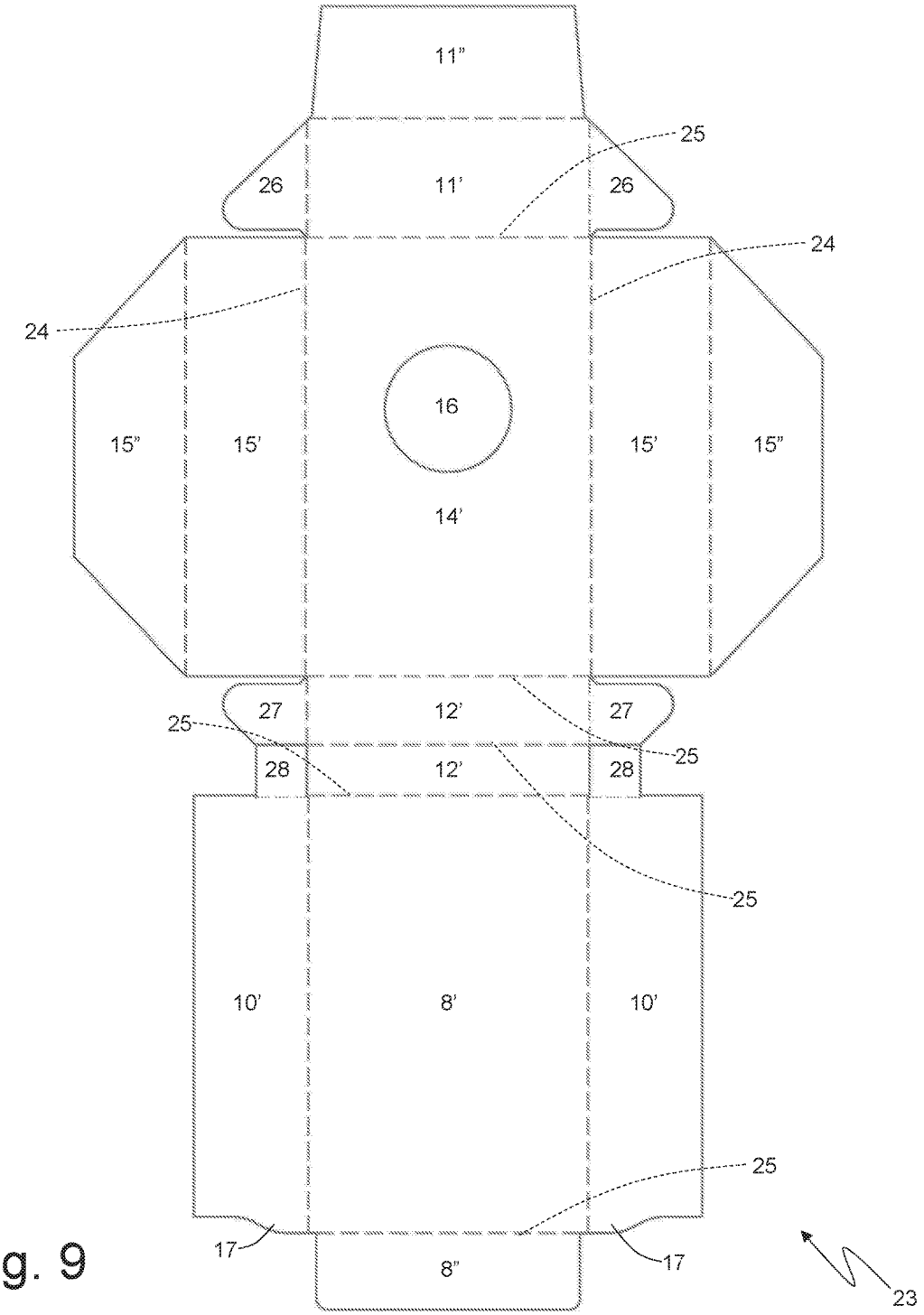
FIG. 9 is a plan view of a variant of the blank in FIG. 8.

FIG. 9 shows an alternative embodiment of the blank 23 to make a cigarette packet 1 in which the main hinge 5, instead of being coincident with the front edge of the bottom wall 12 of the outer container 4 as in the embodiment shown in FIGS. 1-8, is located in an intermediate position of the bottom wall 12 of the outer container 4 (i.e. it is arranged approximately halfway across the bottom wall 12 at a certain distance from a front edge of the bottom wall 12 and at a certain distance from a rear edge of the bottom wall 12). In this embodiment, panel 12' forming the bottom wall 12 of the outer container 4 has a transverse line of weakness 25 inside it that forms the main hinge 5. Furthermore, in this embodiment, panel 12' has the pair of tabs 27 that are folded 90° with respect to panel 12' and glued to the insides of wings 15' and also a pair of tabs 28 that are folded 90° with respect to panel 12' and glued to the insides of wings 10'.

Figure 10:
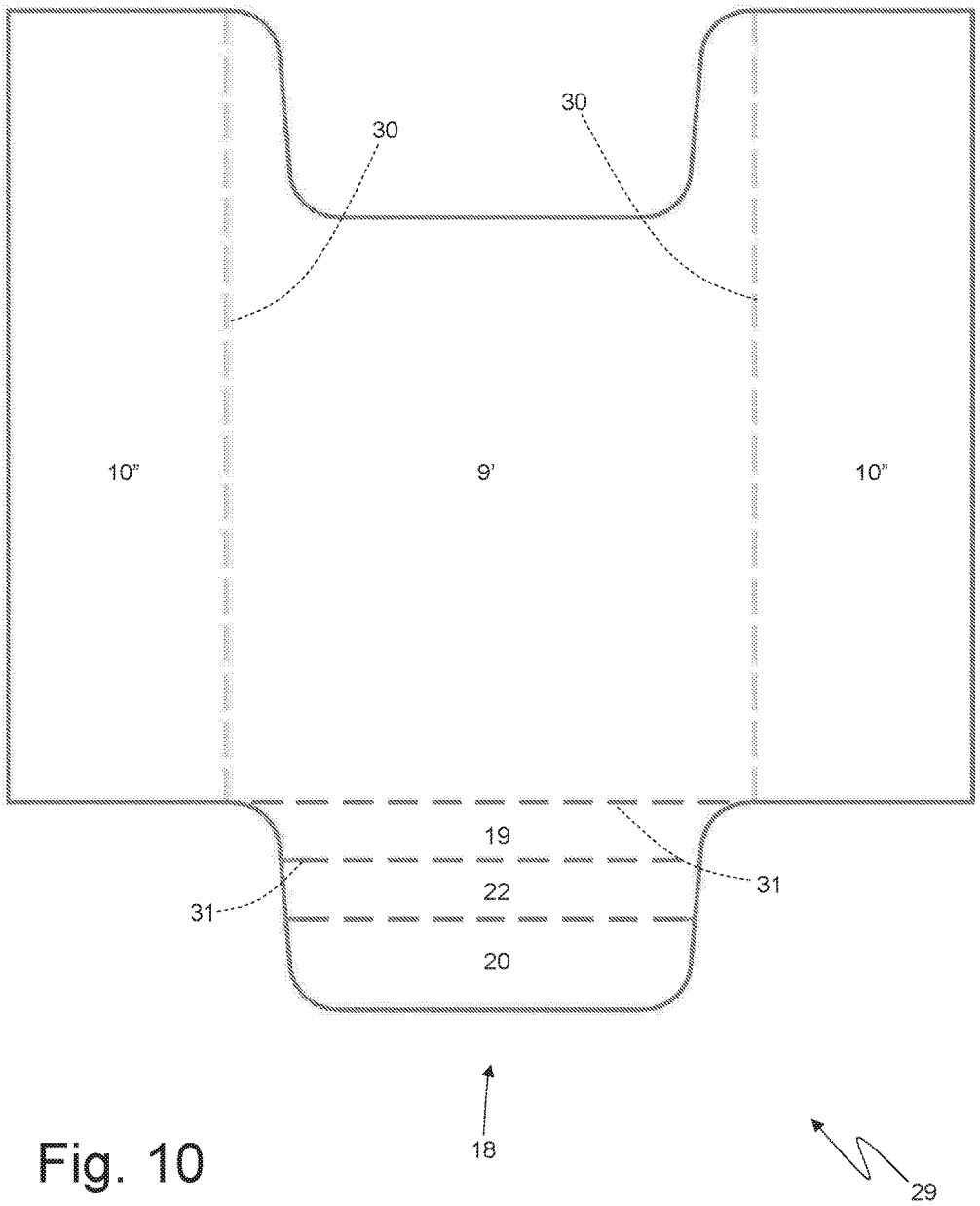
FIG. 10 is a plan view of a blank used to make part of an inner container of the cigarette packet in FIG. 1.
Figure 11:
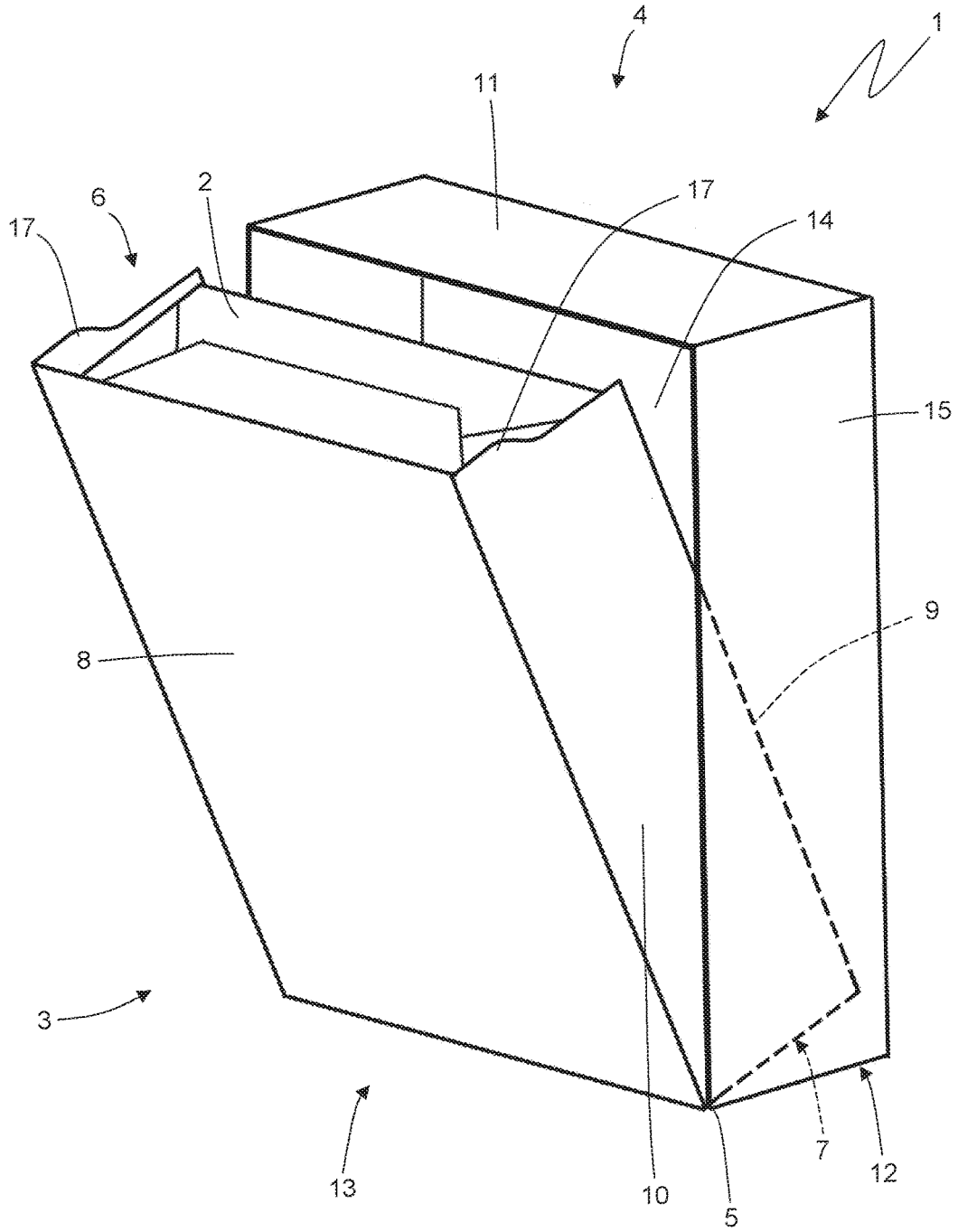
FIG. 11 is a front perspective view of a different embodiment of the cigarette packet in FIG. 1 in an open configuration.
Figure 12:
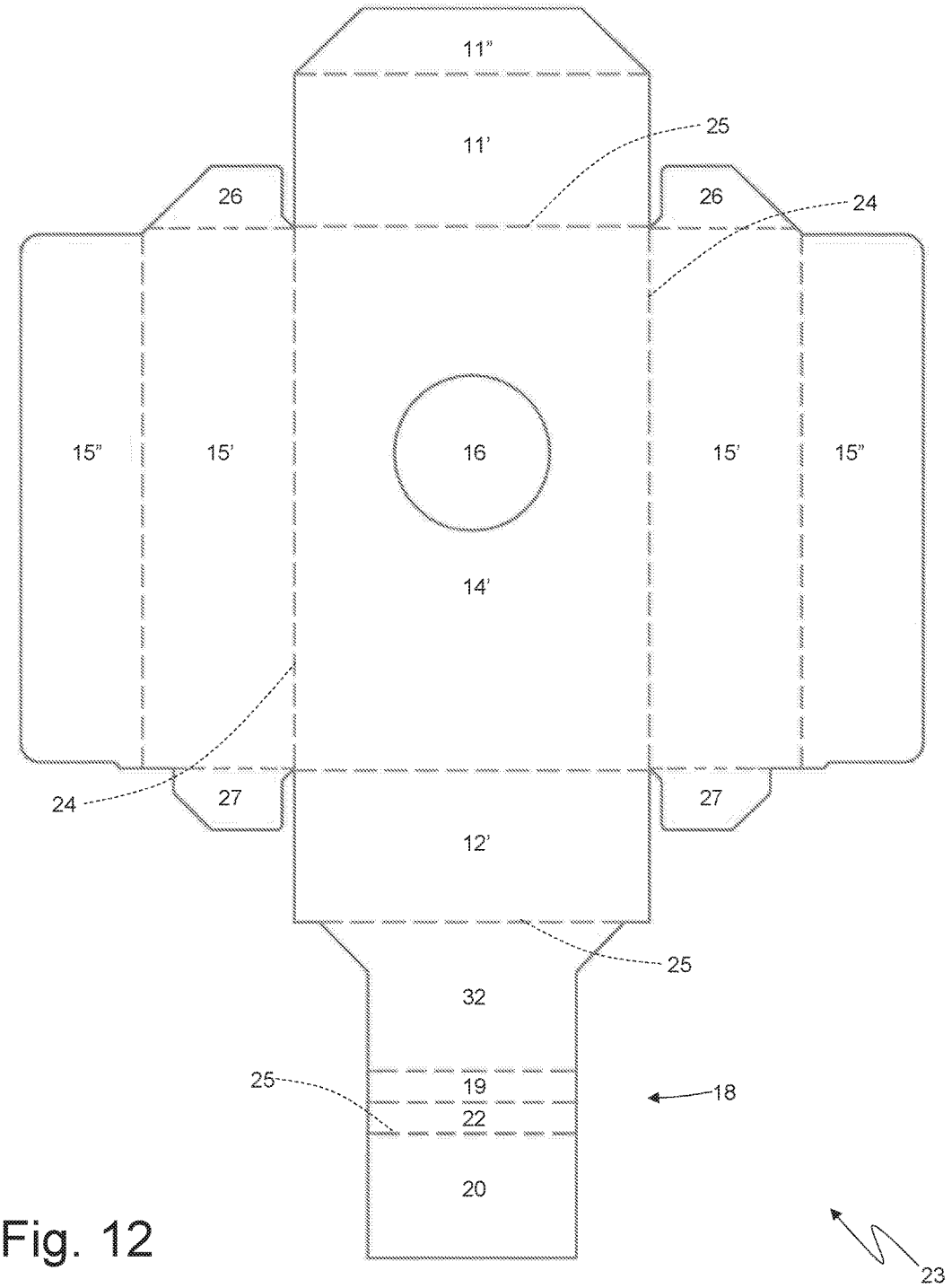
FIG. 12 is a plan view of a blank used exclusively to make an entire outer container of the cigarette packet in FIG. 11.

As shown in FIG. 10 the inner container 3 is partly obtained by folding a flat, substantially oblong blank 29, the parts of which, where possible, are indicated with accented reference numerals equal to the reference numerals identifying the corresponding parts of the inner container 3. In fact, some parts of the inner container 3 belong to blank 29, while the remaining parts of the inner container 3 belong to blank 23 as previously described.

Blank 29 has two longitudinal lines of weakness 30 and a plurality of transverse lines of weakness 31 that define, between the two longitudinal lines of weakness 30, a panel 9' forming the rear wall 9 of the inner container 3 and the stop tab 18 (inside which panels 19, 20 and 21 are separated from each other by transverse lines of weakness 31). Panel 9' has a pair of wings 10", which form an inner part of the lateral walls 10 of the inner container 3, are glued to the insides of wings 10', are arranged on opposite sides of the panel 9 and are separated from panel 9' by longitudinal lines of weakness 30.

Figure 13:
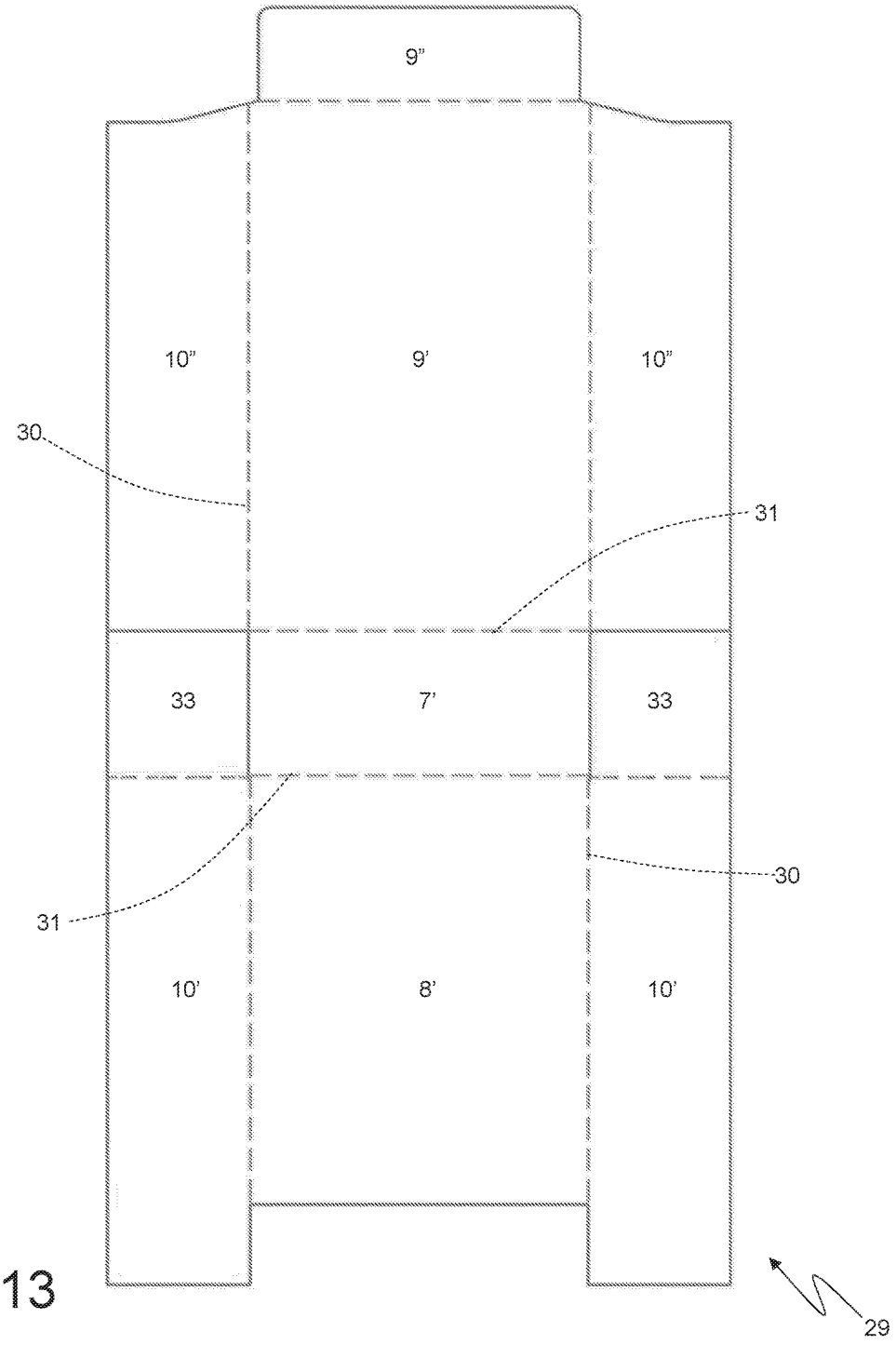
FIG. 13 is a plan view of a blank used exclusively to make an entire inner container of the cigarette packet in FIG. 11.

In the embodiments shown in FIGS. 1-10, the inner container 3 has no bottom wall (the group 2 of cigarettes consequently rests directly on the bottom wall 12 of the outer container 4) and is made by combining (i.e. by gluing together) parts of blank 23 and parts of blank 29 (in other words, the inner container 3 is divided between both blanks 23 and 29). Instead, in the embodiment shown in FIGS. 11-17, the inner container 3 has a bottom wall 7 and is entirely made using just blank 29 (shown in FIG. 13 and having panel 7' forming the bottom wall 7 of the inner container 3); in this embodiment, the stop tab 18 is part of blank 23 (from which the outer container 4 is made) and is hinged to a connecting panel 32 which is glued to the bottom wall 7 of the inner container 3 to hinge the two containers 3 and 4 together. In other words, the outer container 4 is provided with a connecting panel 32 that is folded 180° against an inner surface of the bottom wall 12 of the outer container 4, is glued to the bottom wall 7 of the inner container 3, and defines the main hinge 5 of rotation at a transverse line of weakness 25 that separates the connecting panel 32 from panel 12', which forms the bottom wall 12 of the outer container 4.

Figure 14:
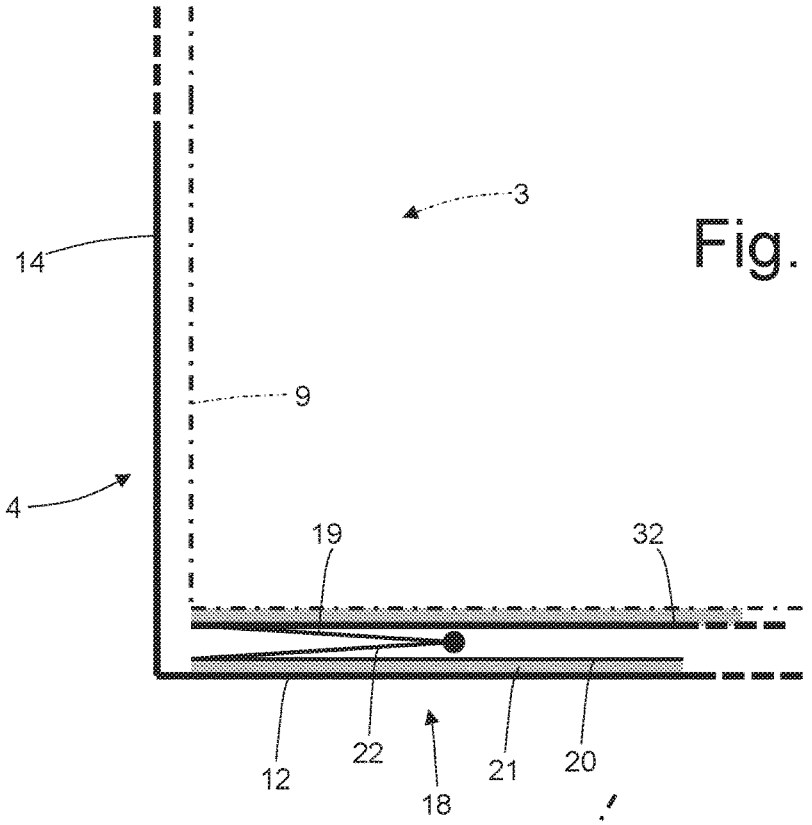
FIGS. 14 and 15 are two schematic views of a bottom part of the cigarette packet in FIG. 11 in a closed configuration and in an open configuration, respectively.
Figure 15:
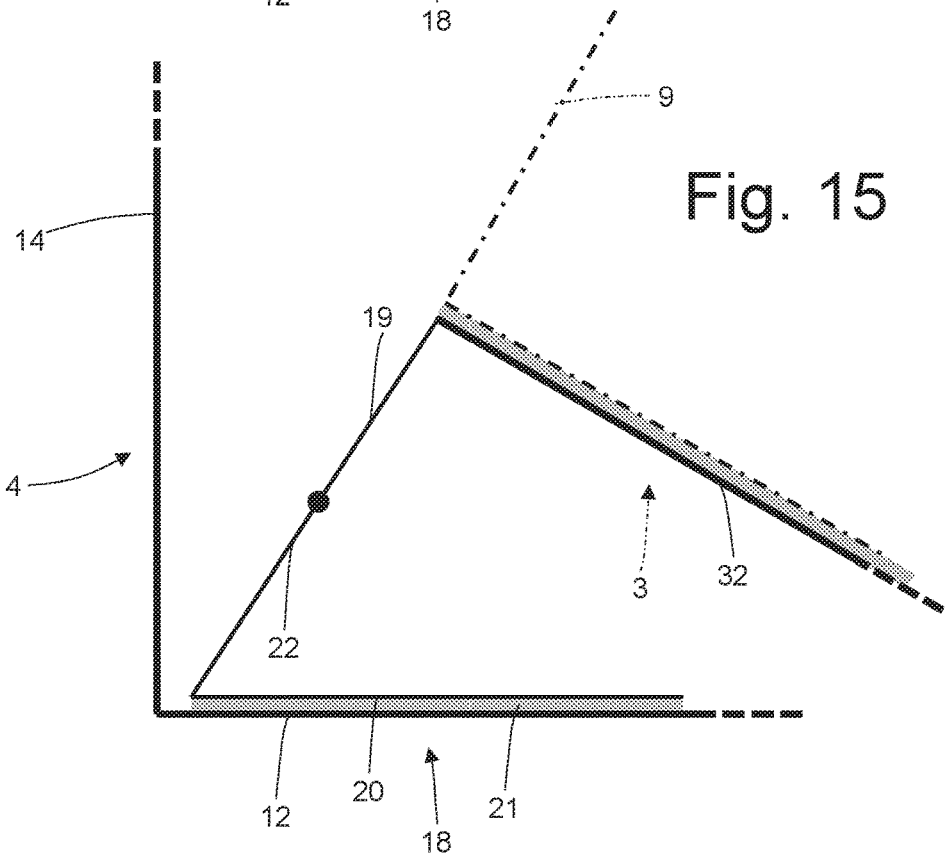
Figure 16:
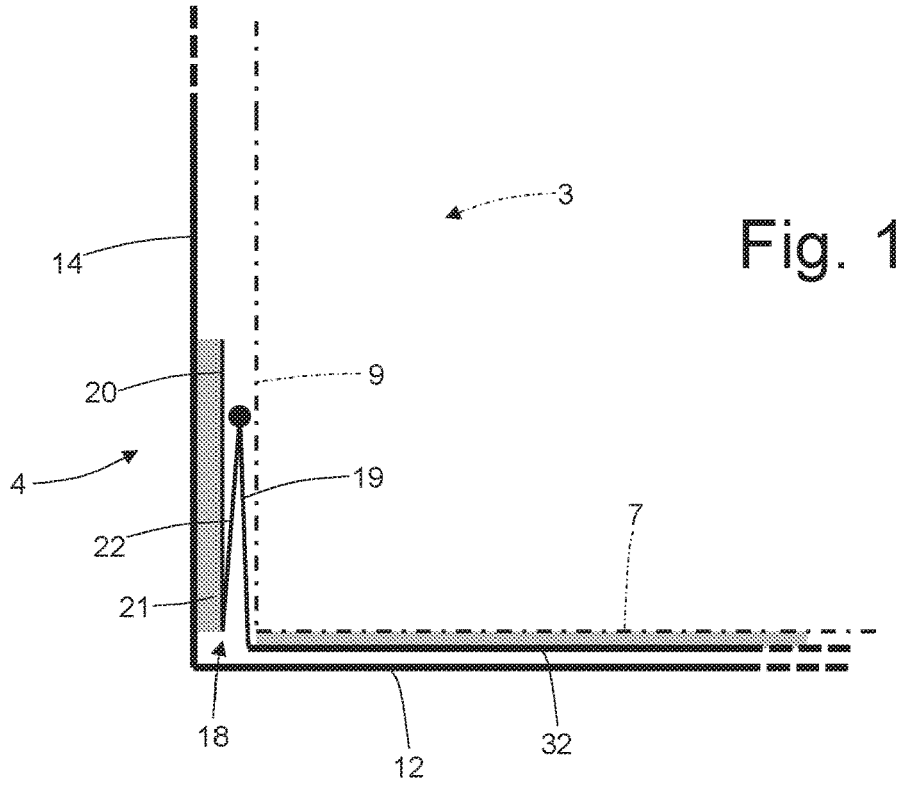
FIGS. 16 and 17 are two schematic views of a bottom part of a variant of the cigarette packet in FIG. 11 in a closed configuration and in an open configuration, respectively.
Figure 17:
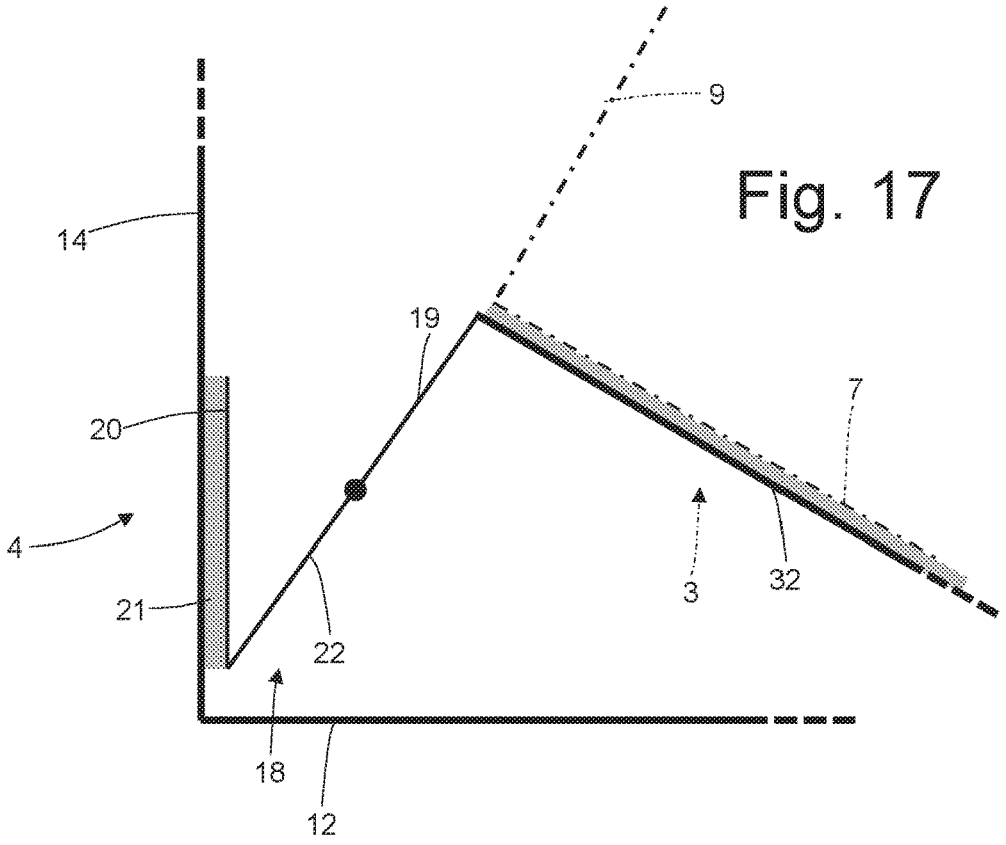

As previously mentioned, the stop tab 18 is integral with the connecting panel 32 which is glued to the bottom wall 7 of the inner container 3; in consequence, the stop tab 18 (in particular, the inner panel 19 of the stop tab 18) is integral with the bottom wall 7 of the inner container 3. As shown in FIGS. 14 and 15, the outer panel 20 of the stop tab 18 is glued to the bottom wall 12 of the outer container 4 by glue (similarly to that shown in FIGS. 4 and 5); alternatively, and as shown in FIGS. 16 and 17, the outer panel 20 of the stop tab 18 is glued to the rear wall 14 of the outer container 4 by glue 21 (similarly to that shown in FIGS. 6 and 7).

Figure 18:
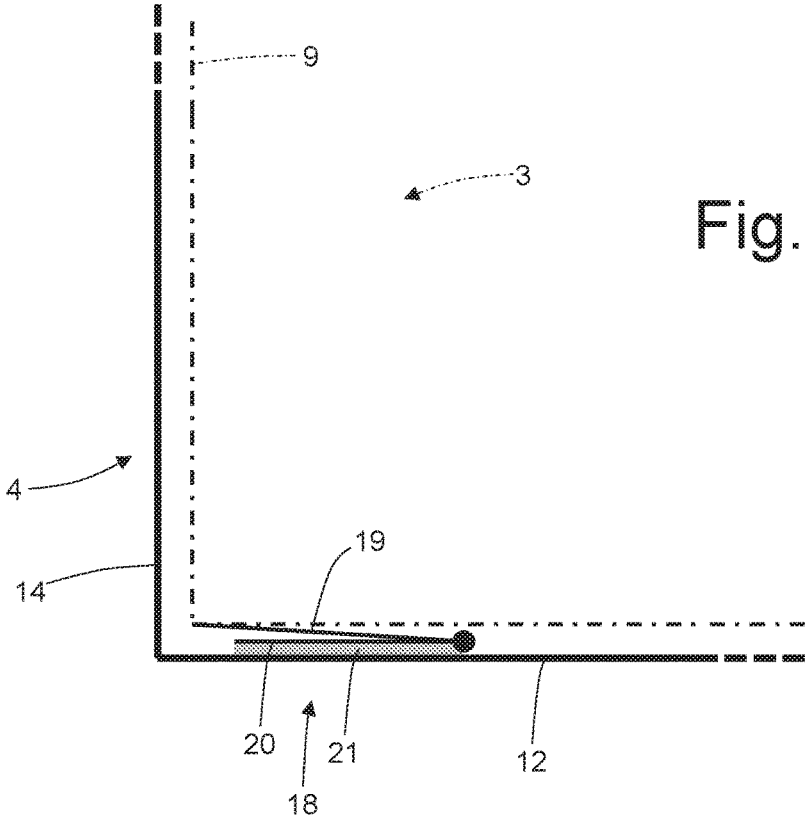
FIGS. 18 and 19 are two schematic views of a bottom part of a variant of the cigarette packet in FIG. 1 in a closed configuration and in an open configuration, respectively.
Figure 19:
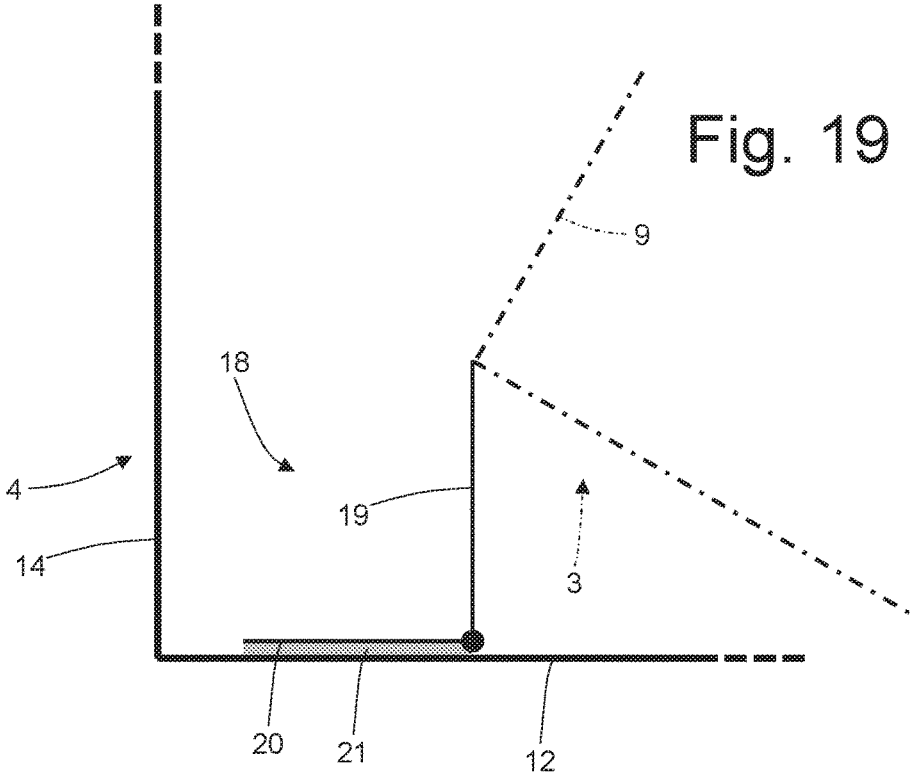
Figure 20:
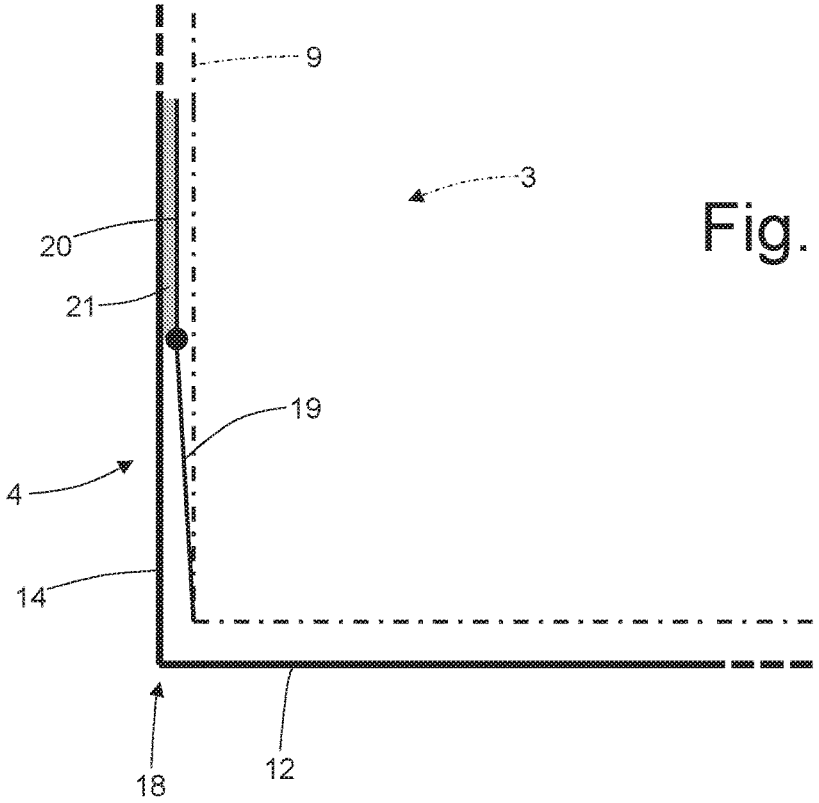
FIGS. 20 and 21 are two schematic views of a bottom part of a further variant of the cigarette packet in FIG. 1 in a closed configuration and in an open configuration, respectively.
Figure 21:
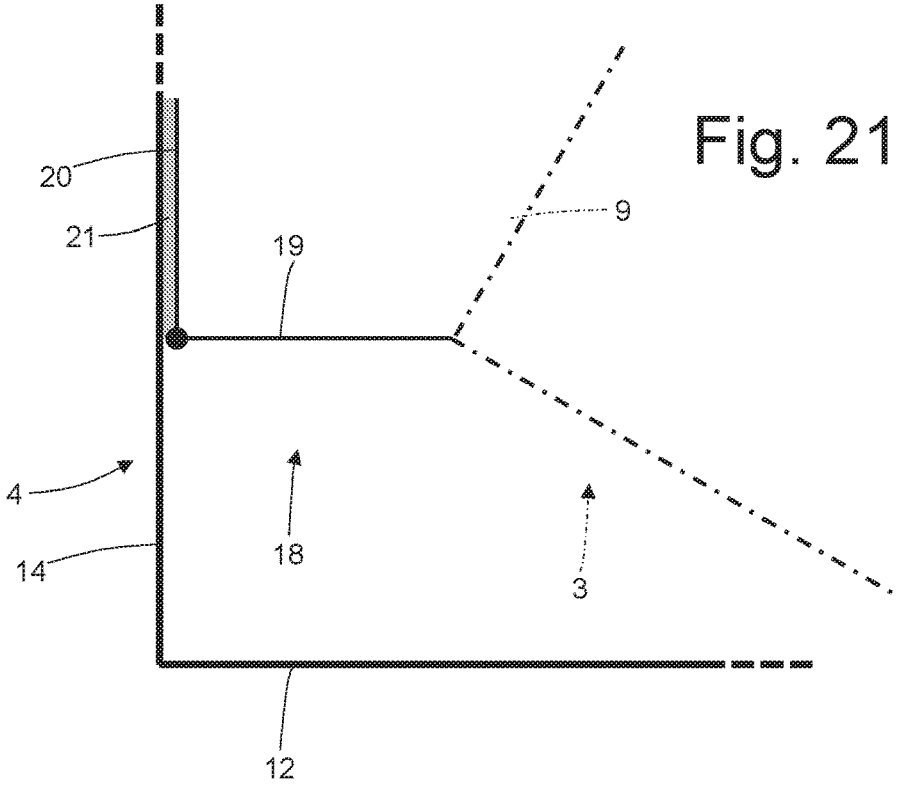
Figure 22:
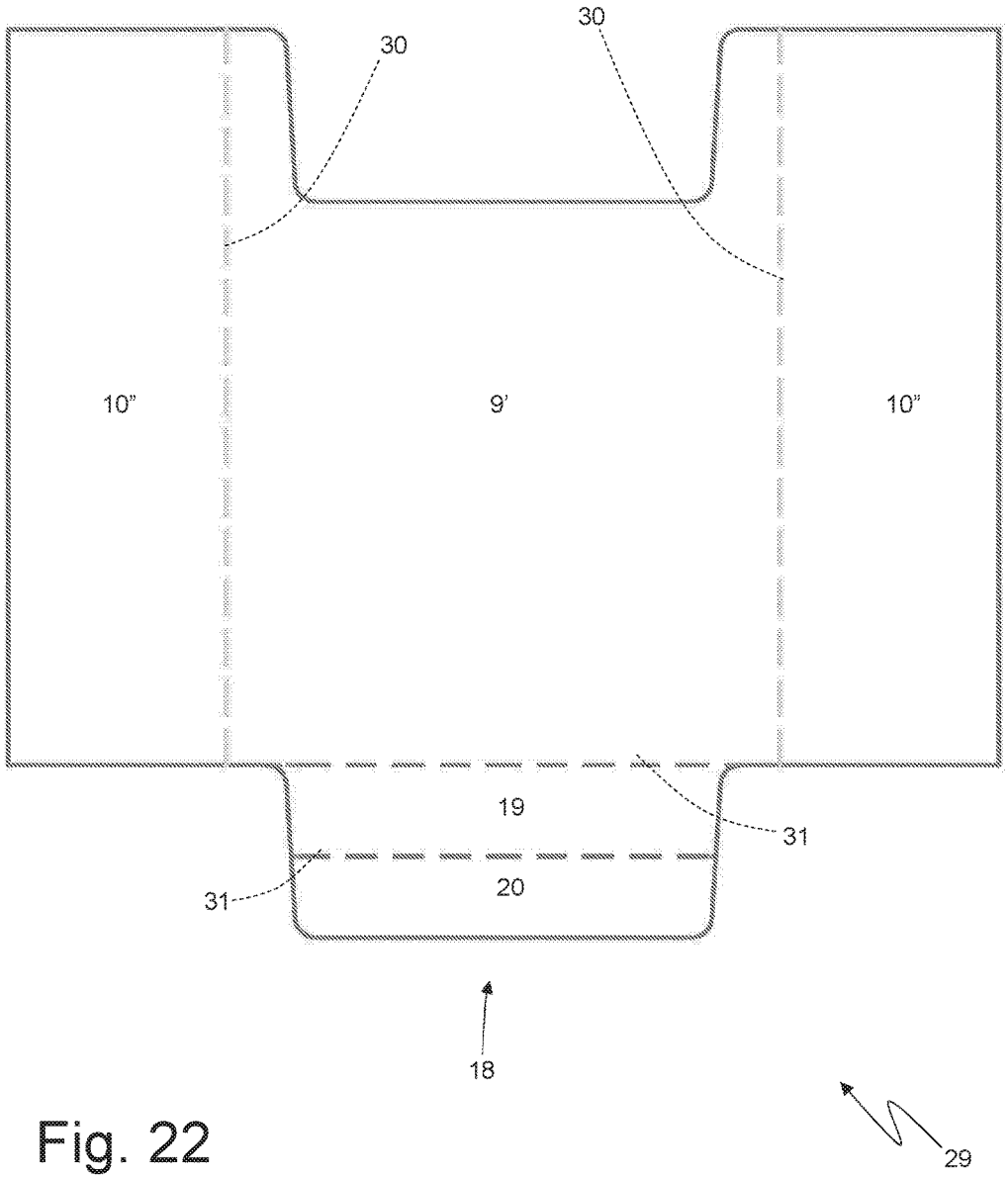
FIG. 22 is a plan view of a blank used to make part of an inner container of the cigarette packet in FIGS. 18-21.

FIGS. 18-22 show a further embodiment, in which the stop tab does not have the intermediate panel 22 (i.e. the inner panel 19 of the stop tab 18 is connected directly to the outer panel 20 of the stop tab 18 without the interposition of the intermediate panel 22, which is absent). In this embodiment as well, the outer panel 20 of the stop tab 18 can be glued to the bottom wall 12 of the outer container 4 (as shown in FIGS. 18 and 19), or to the rear wall 14 of the outer container 4 (as shown in FIGS. 20 and 21) by glue 21. It is important to underline that the embodiments shown in FIGS. 1-17 where the stop tab 18 also has the intermediate panel 22 are preferable, as the presence of the intermediate panel 22 enables improving the operation of the stop tab 18, allowing simpler and more natural movement of the stop tab 18; in other words, inserting the intermediate panel 22 in the stop tab 18 (with consequent resizing of the inner panel 19) enables achieving simpler and more natural movement (i.e. deformation) of the stop tab 18 during rotation of the inner container 3 with respect to the outer container 4 about the main hinge 5.

Figure 23:
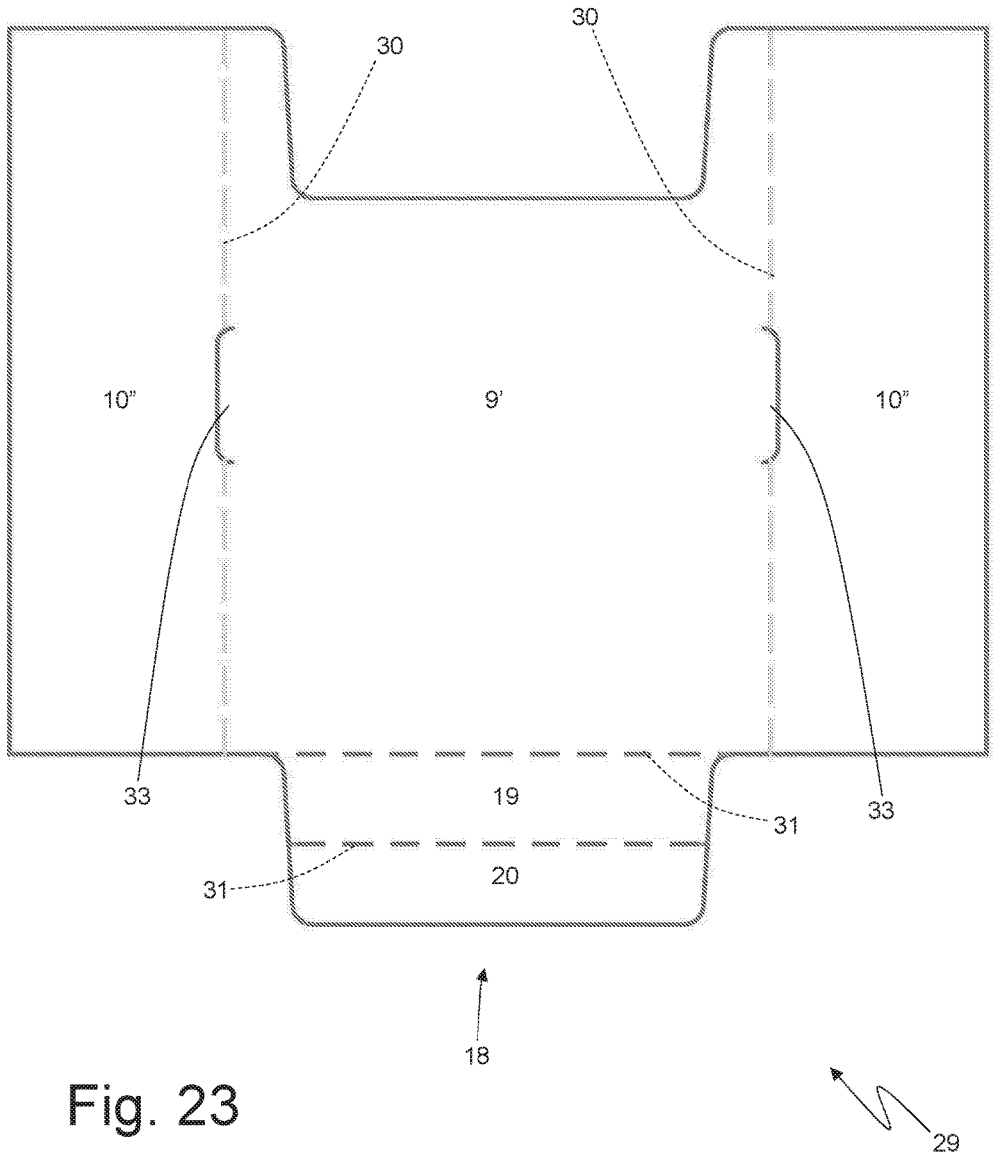
FIG. 23 is a plan view of a variant of the blank in FIG. 22.
Figure 24:
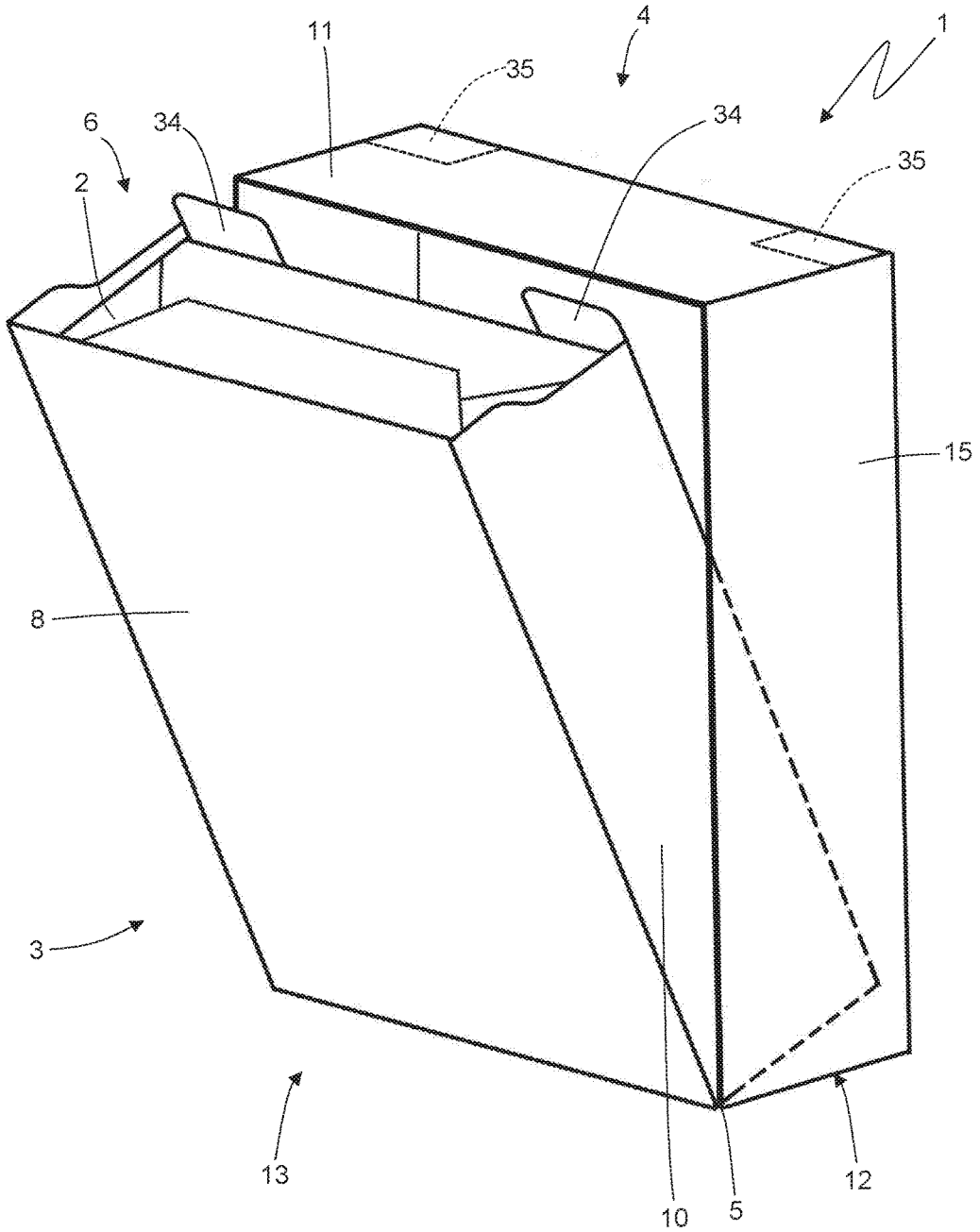
FIG. 24 is a front perspective view of a variant of the cigarette packet in FIG. 1 in an open configuration.
Figure 25:
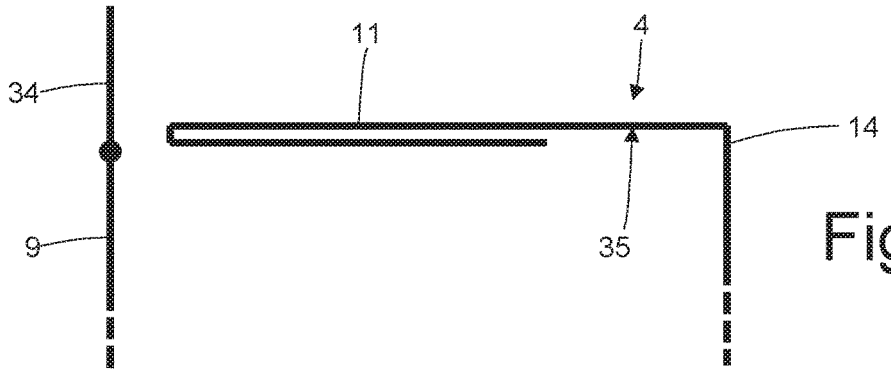
FIGS. 25-28 are four schematic views of a top part of the cigarette packet in FIG. 1 in different positions of the inner container with respect to the outer container.

FIG. 23 shows a variant of the blank 29 used to make the inner container 3 in which the retaining member that keeps the inner container 3 in the closed position (i.e. inside the outer container 4, as shown in FIGS. 1 and 2) with a given retaining force has a different shape. In the embodiment shown in FIG. 23, instead of comprising retaining appendages 17 that project upwards from the lateral walls 10 of the inner container 3, the retaining member comprises two retaining appendages 33 that project outwards from the rear wall 9 of the inner container 3 (i.e. constituting a natural upwards continuation of the rear wall 9 of the inner container 3). The retaining appendages 33 are sized to interfere mechanically with the lateral walls 15 of the outer container 4 when the inner container 3 is in the closed position (i.e. when it is inside the outer container 4, as shown in FIGS. 1 and 2); in other words, the retaining appendages 33 interfere with (frictionally rub against) the lateral walls 15 of the outer container 4 and therefore a slight elastic deformation (of both the retaining appendages 33 and the lateral walls 15) is necessary to allow extraction of the inner container 3 from the outer container 4. The interference of the retaining appendages 33 with the lateral walls 15 of the outer container 4 generates the retaining force that keeps the inner container 3 in the closed position (i.e. inside the outer container 4, as shown in FIGS. 1 and 2); in other words, the retaining appendages 33 press against the inner surface of the lateral walls 15 of the outer container 4 and therefore give rise to a frictional force between the retaining appendages 33 and the lateral walls 15, which constitutes the retaining force that keeps the inner container 3 in the closed position (i.e. inside the outer container 4, as shown in FIGS. 1 and 2).

Figure 26:
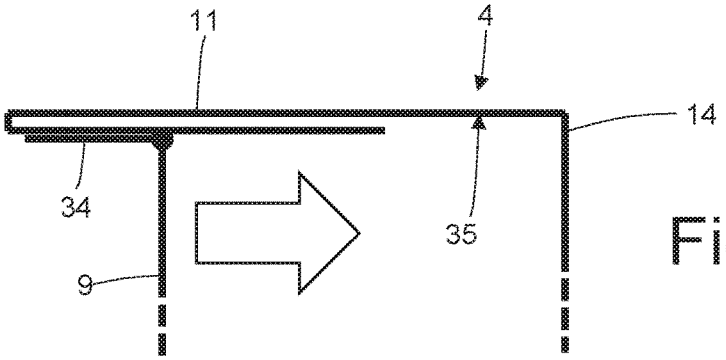
Figure 27:
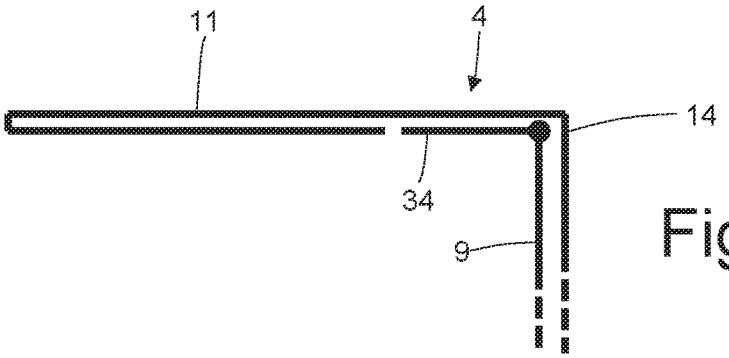
Figure 28:
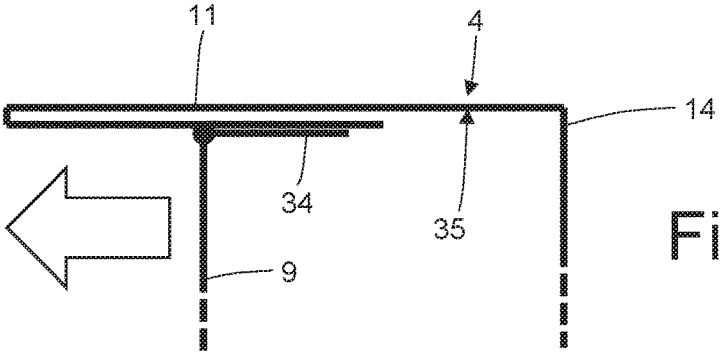

FIGS. 24-30 show a variant of the cigarette packet 1 in which the retaining member that keeps the inner container 3 in the closed position (i.e. inside the outer container 4, as shown in FIGS. 1 and 2) with a given retaining force has a different shape. In the embodiment shown in FIGS. 24-30, instead of comprising the stop tabs 17 or 33 that mechanically interfere with the outer container 4, the retaining member comprises a pair of retaining tabs 34 that project upwards from the rear wall 9 of the inner container 3 (i.e. constituting a natural upwards continuation of the rear wall 9 of the inner container 3) and are hinged to the top edge of the rear wall 9. Furthermore, the retaining member comprises a pair of retaining seats 35, which are made inside the top wall 11 of the outer container 4, close to the rear wall 14 of the outer container 4, and reproduce the negative shape of the retaining tabs 34. When the inner container 3 moves from the open position (shown in FIGS. 24 and 25) to the closed position (shown in FIG. 27), the retaining tabs 34 strike against the edge of the top wall 11 of the outer container 4 and bend 90° with respect to the rear wall 9 of the inner container 3 and towards the inside of the inner container 3, i.e. towards the top wall of the wrapped group 2 of cigarettes (as shown in FIG. 26). When the inner container 3 is in the closed position (shown in FIG. 27), the retaining tabs 34 are bent 90° with respect to the rear wall 9 of the inner container 3 and are housed inside the corresponding retaining seats 35. When the inner container 3 moves from the closed position to the open position, the retaining tabs 34 jam against the inner edges of the corresponding retaining seats 35, bending 90° with respect to the rear wall 9 of the inner container 3 and towards the outside of the inner container 3, i.e. moving away from the top wall of the wrapped group 2 of cigarettes. When the inner container 3 emerges from the outer container 4, the retaining tabs 34 are no longer constrained by the top wall 11 of the outer container 4 and elastically return to the vertical position (shown in FIG. 25). In other words, the retaining tabs 34 bend 90° in one direction when the inner container 3 moves from the open position to the closed position and bend 90° in the opposite direction when the inner container 3 moves from the closed position to the open position.

When the inner container 3 is in the closed position (shown in FIG. 27), in order to move the inner container 3, it is necessary that the retaining tabs 34 perform an outward rotation of 90° with respect to the rear wall 9 of the inner container 3, i.e. moving away from the top surface of the wrapped group 2 of cigarettes; to perform this rotation of the retaining tabs 34, a certain elastic deformation of both the retaining tabs 34 and the top wall 11 of the outer container 4 is necessary, this elastic deformation requiring the application of a certain force, corresponding to the retaining force that keeps the inner container 3 in the closed position (i.e. inside the outer container 4, as shown in FIGS. 1 and 2).

It is important to note that the rotations of the retaining tabs 34 during the opening movement of the cigarette packet 1 (i.e. when the inner container 3 moves from the closed position to the open position) can generate noise (or rather sounds similar to a 'click') that, far from being negative, are generally appreciated by users as being an indication of correct functioning of the cigarette packet 1.

Figure 29:
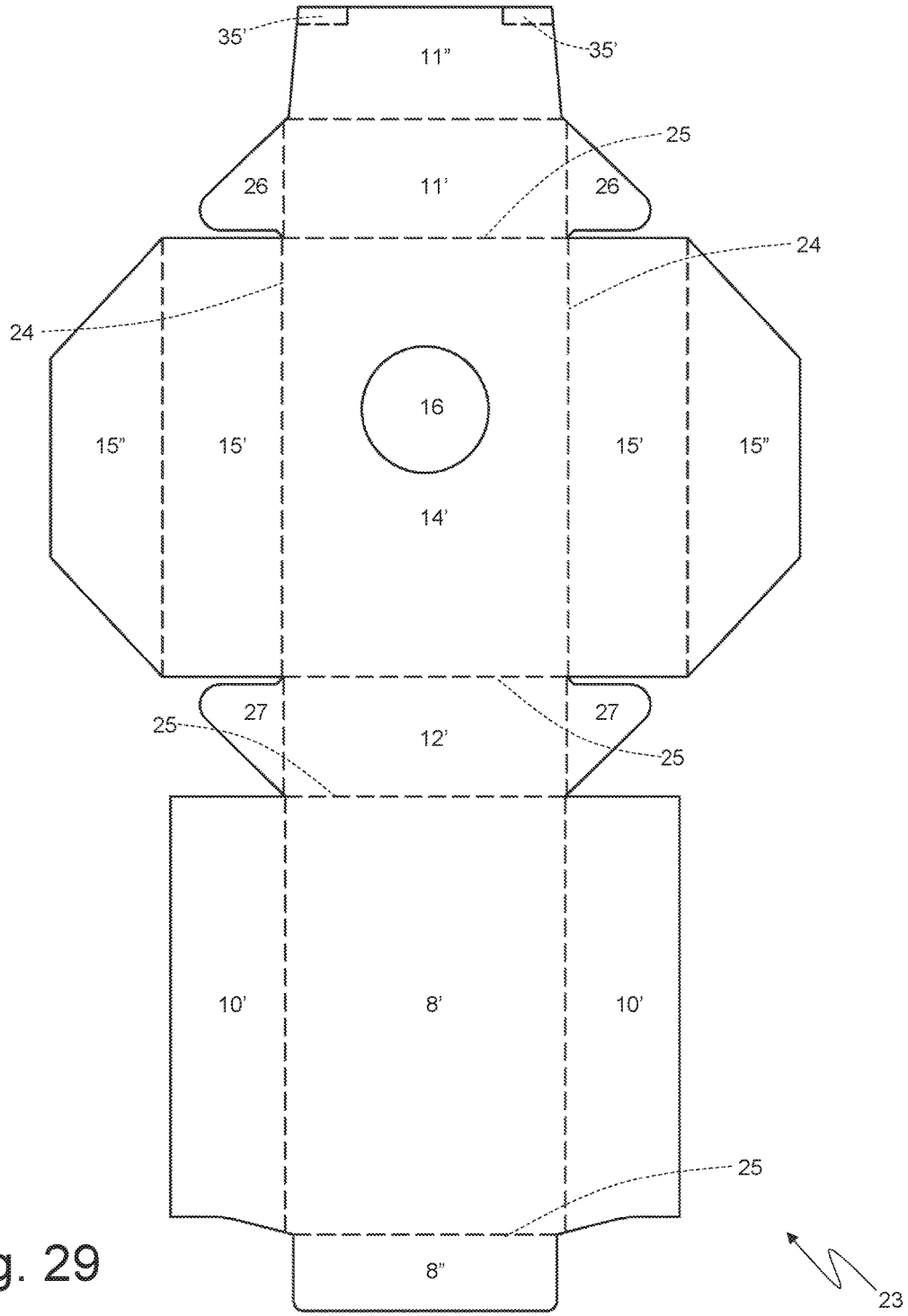
FIG. 29 is a plan view of a blank used to make an outer container and part of an inner container of the cigarette packet in FIG. 24.
Figure 30:
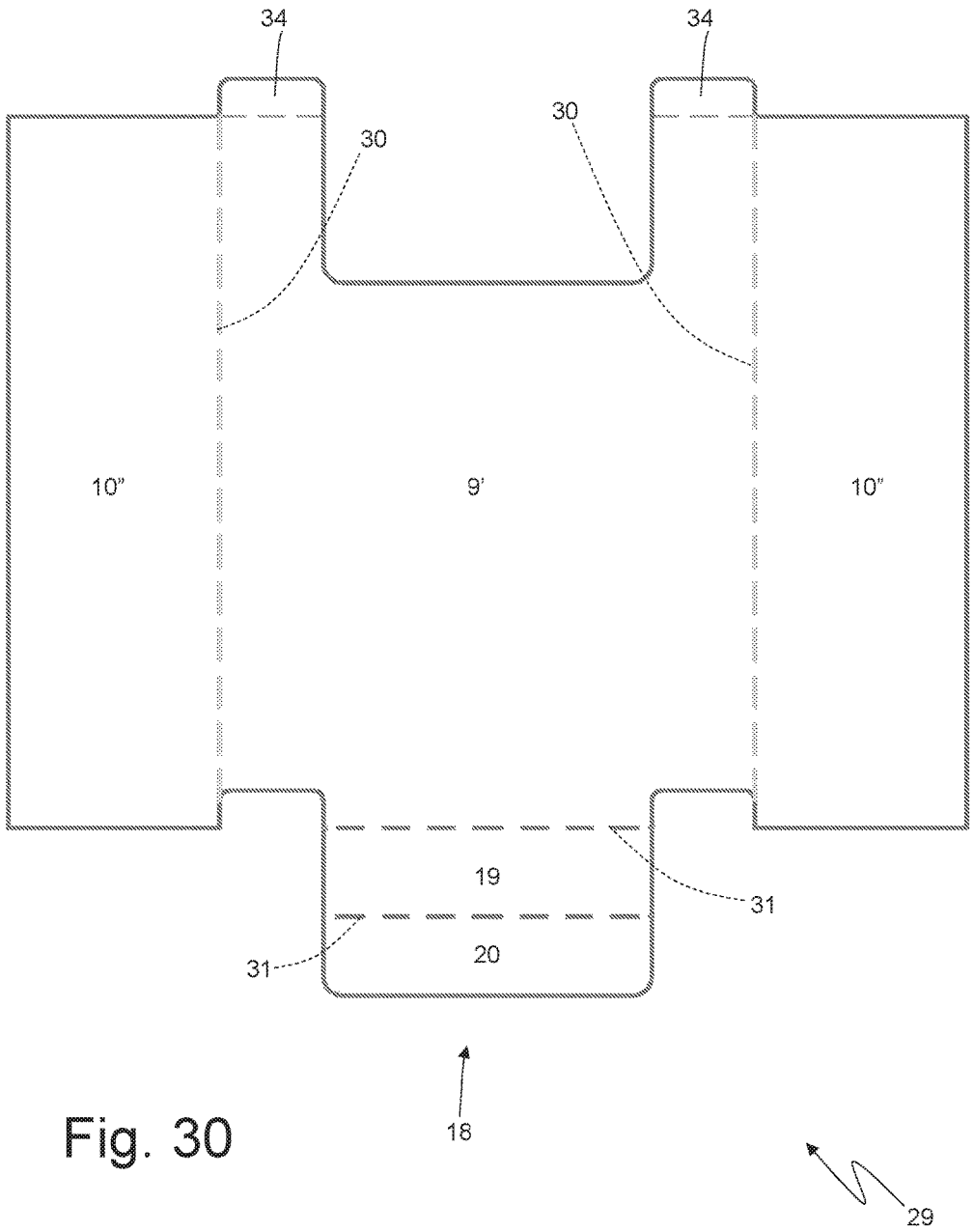
FIG. 30 is a plan view of a blank used to make part of an inner container of the cigarette packet in FIG. 24.

Finally, as shown in FIG. 29, it is important to note that the retaining seats 35 can be obtained by exploiting reinforcing panel 11", which forms the internal reinforcement of the top wall 11 of the outer container 4 and is glued to an inner surface of panel 11'. The reinforcing panel 11" can have two recesses made by removing the wrapping material near the two retaining seats 35, or the reinforcing panel 11" could have two tabs 35 that are folded 180° and glued against reinforcing panel 11" to make the two retaining seats 35.

Figure 31:
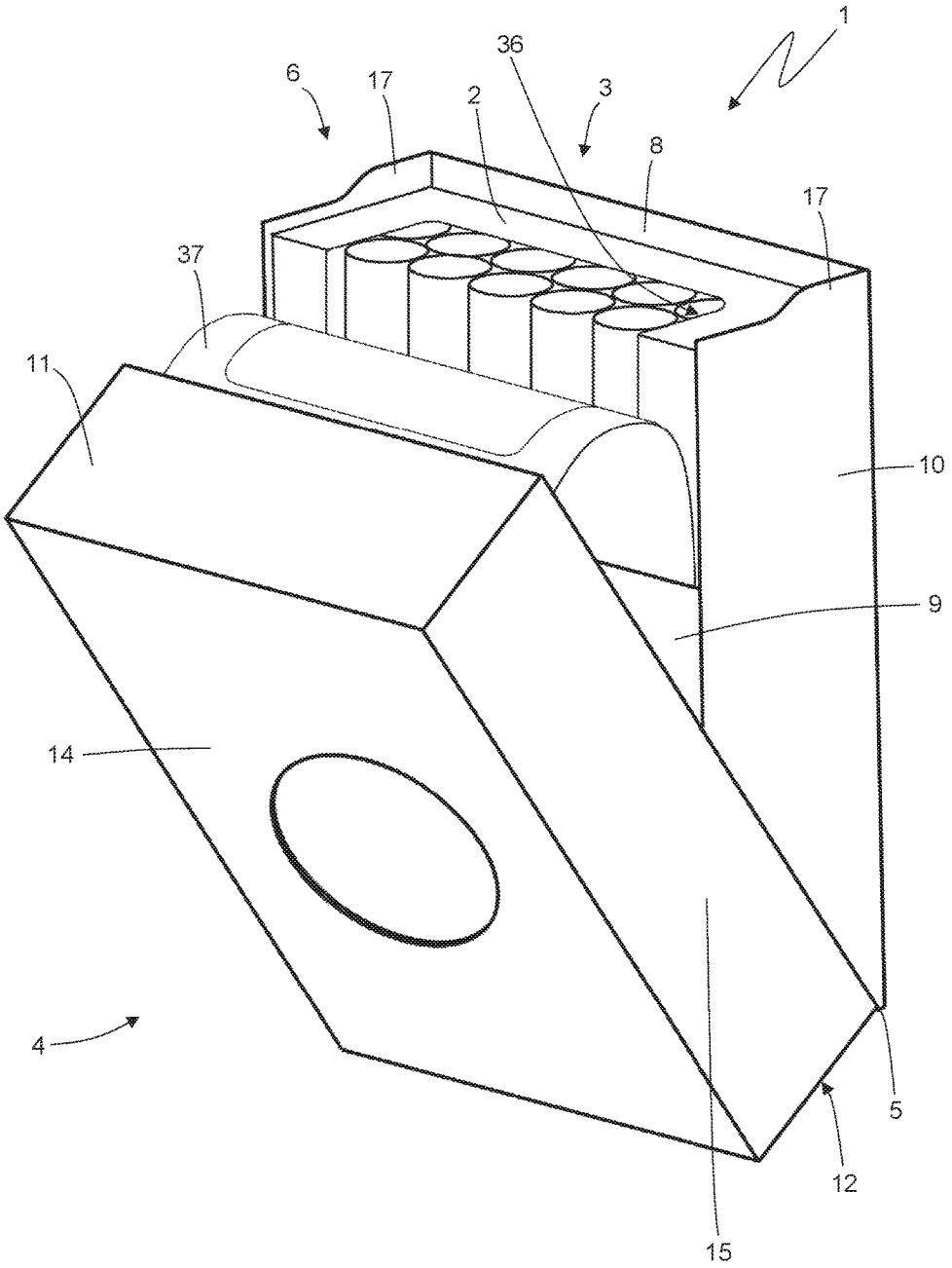
FIGS. 31 and 32 are respectively a rear perspective view and a front perspective view of a variant of the cigarette packet in FIG. 1 in an open configuration.
Figure 32:
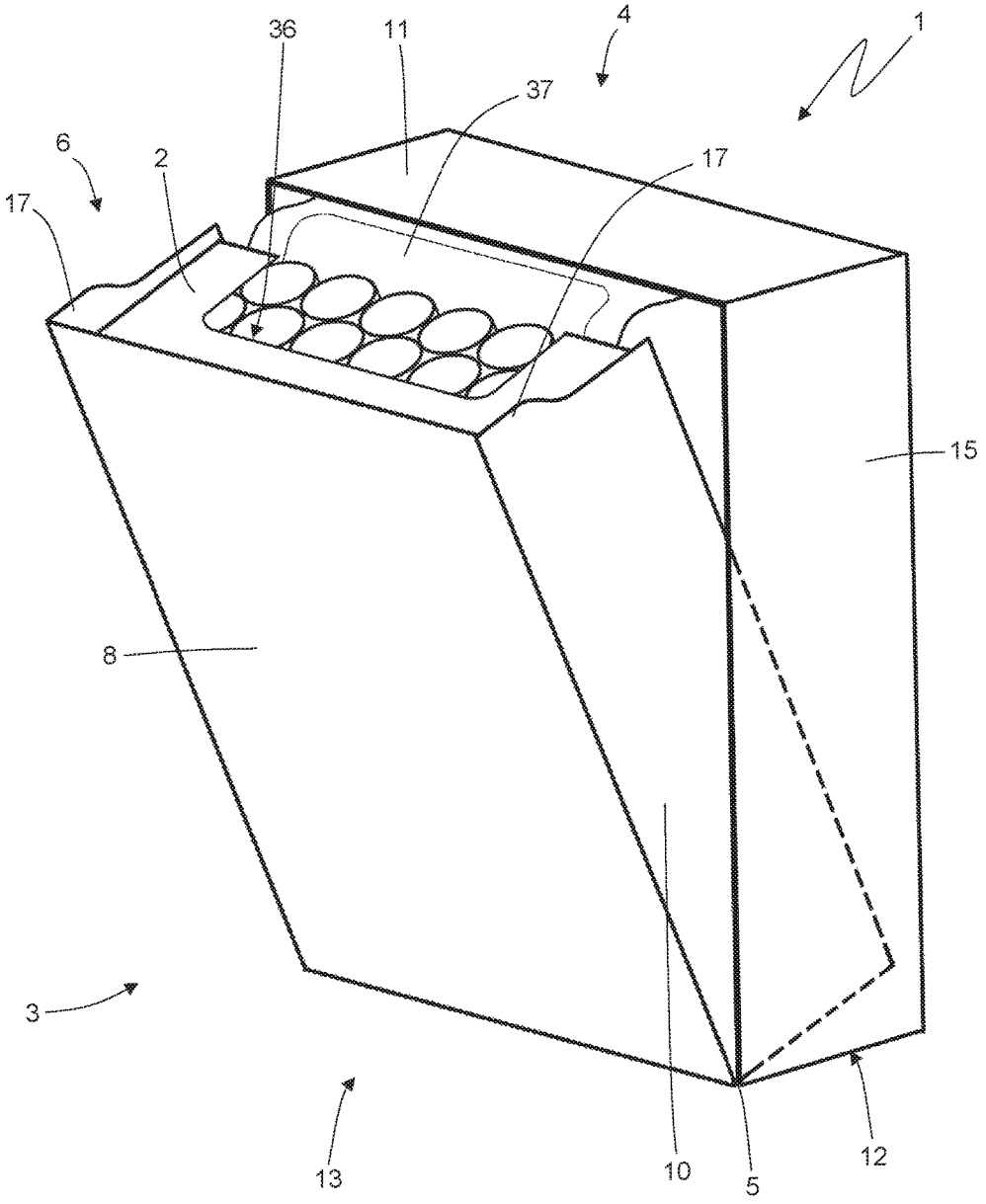
Figure 33:
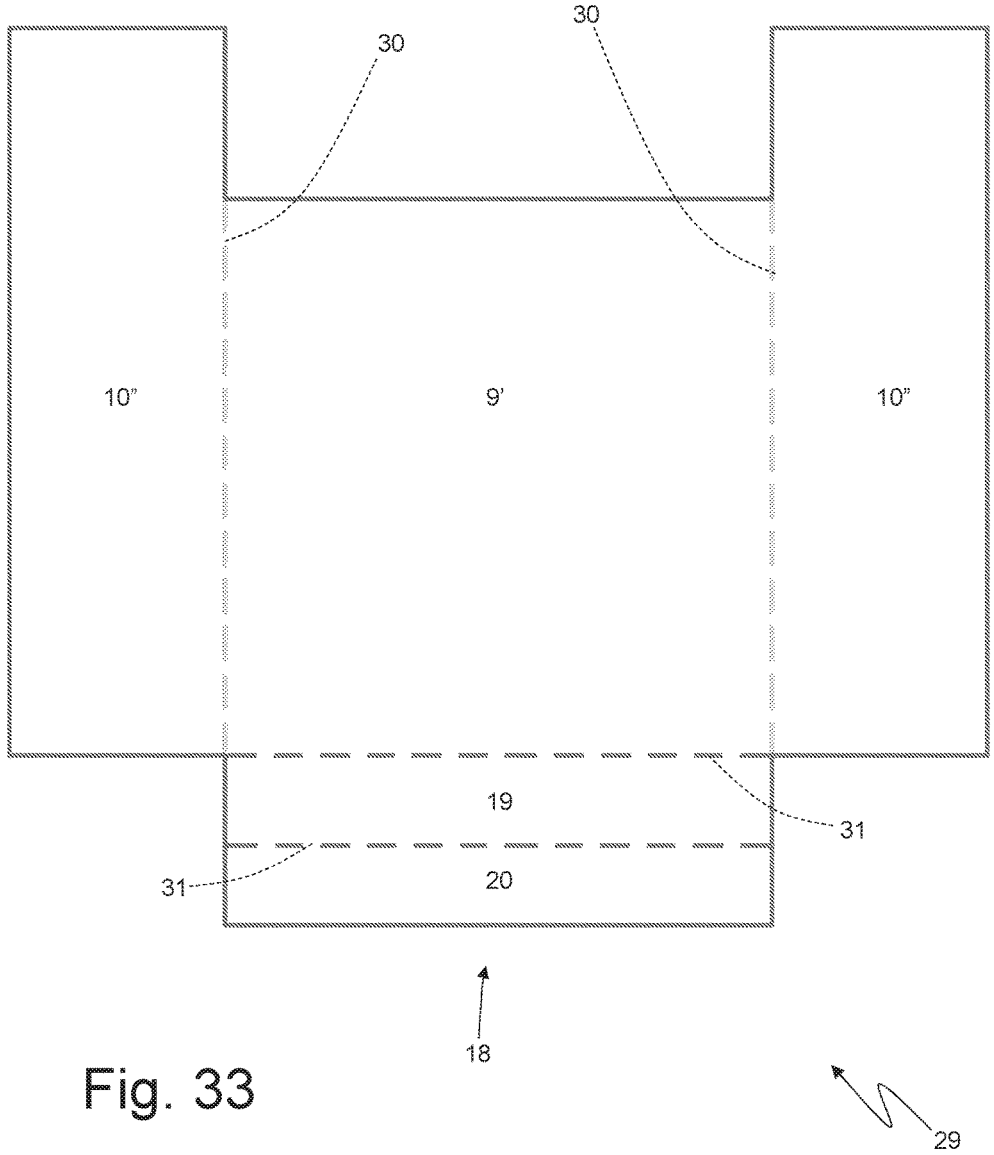
FIG. 33 is a plan view of a blank used to make part of an inner container of the cigarette packet in FIGS. 31 and 32.

FIGS. 31, 32 and 33 show a different embodiment of the cigarette packet 1, in which the group 2 of cigarettes is enclosed in a sealed wrapper that has an upper frontal extraction opening 36 for the cigarettes; the extraction opening 36 for the cigarettes being arranged in the centre, closed by a sealing panel 37 of the 'open & close' type and involving a portion of a rear wall of the sealed wrapper and a portion of the upper part of the sealed wrapper. The sealing panel 37 normally adheres to the part of the sealed wrapper positioned around the extraction opening 36 to close (seal) the extraction opening 36 and can be temporarily lifted up to free the extraction opening 36 and consequently allow extraction of a cigarette through the extraction opening 36. Preferably, a flap of the sealing panel 37 is permanently glued to an inner surface of the top wall 11 of the outer container 4 in such a way that the movement of the inner container 3 with respect to the outer container 4 also causes an 'automatic' (i.e. performed without further user action) opening and closing operation of the sealing panel 37. In other words, by moving the inner container 3 from the closed position to the open position (shown in FIGS. 31 and 32), the sealing panel 37 'automatically' opens (i.e. without further user action) and, similarly, moving the inner container 3 from the open position (shown in FIGS. 31 and 32) to the closed position, the sealing panel 37 'automatically' closes (i.e. without further user action). FIG. 33 shows the modified blank 29 (enlarged upper cut-out) to make the inner container 3 shown in FIGS. 31 and 32.

FIGS. 34-39 show a different embodiment of the cigarette packet 1, in which the inner container 3 comprises a hinged lid 38, which is hinged to the inner container 3 along a lid hinge 39 to rotate with respect to the inner container 3 between an open position (shown in FIG. 34) and a closed position of the open top end 6. The lid 38 comprises a rectangular top wall 40 that is parallel and opposite to the bottom wall 7 of the inner container 3 (if present) when the lid 38 is in the closed position, a rectangular-shaped rear wall 41 that forms a continuation of the rear wall 9 of the inner container 3 when the lid 38 is in the closed position, and two triangular lateral walls 42 that form a continuation of the lateral walls 10 of the inner container 3 when the lid 38 is in the closed position. The lid hinge 39 connects a top edge of the rear wall 9 of the inner container 3 to a bottom edge of the rear wall 41 of the lid 38.

The lid 38 is provided with a control mechanism that connects the lid 38 to the outer container 4 in such a way that the opening/closing movement of the inner container 3 with respect to the outer container 4 'automatically' (i.e. without the user having to touch the lid 38) causes a corresponding opening/closing movement of the lid 38. The control mechanism of the lid 38 comprises a control tab 43 (better shown in FIG. 35), which extends from an edge of the top wall 11 of the outer container 4 towards the inside of the outer container 4, and a slit 44 (better shown in FIG. 36), which is made in the top wall 40 of the lid 38 and designed to be engaged by the control tab 43.

Figure 34:
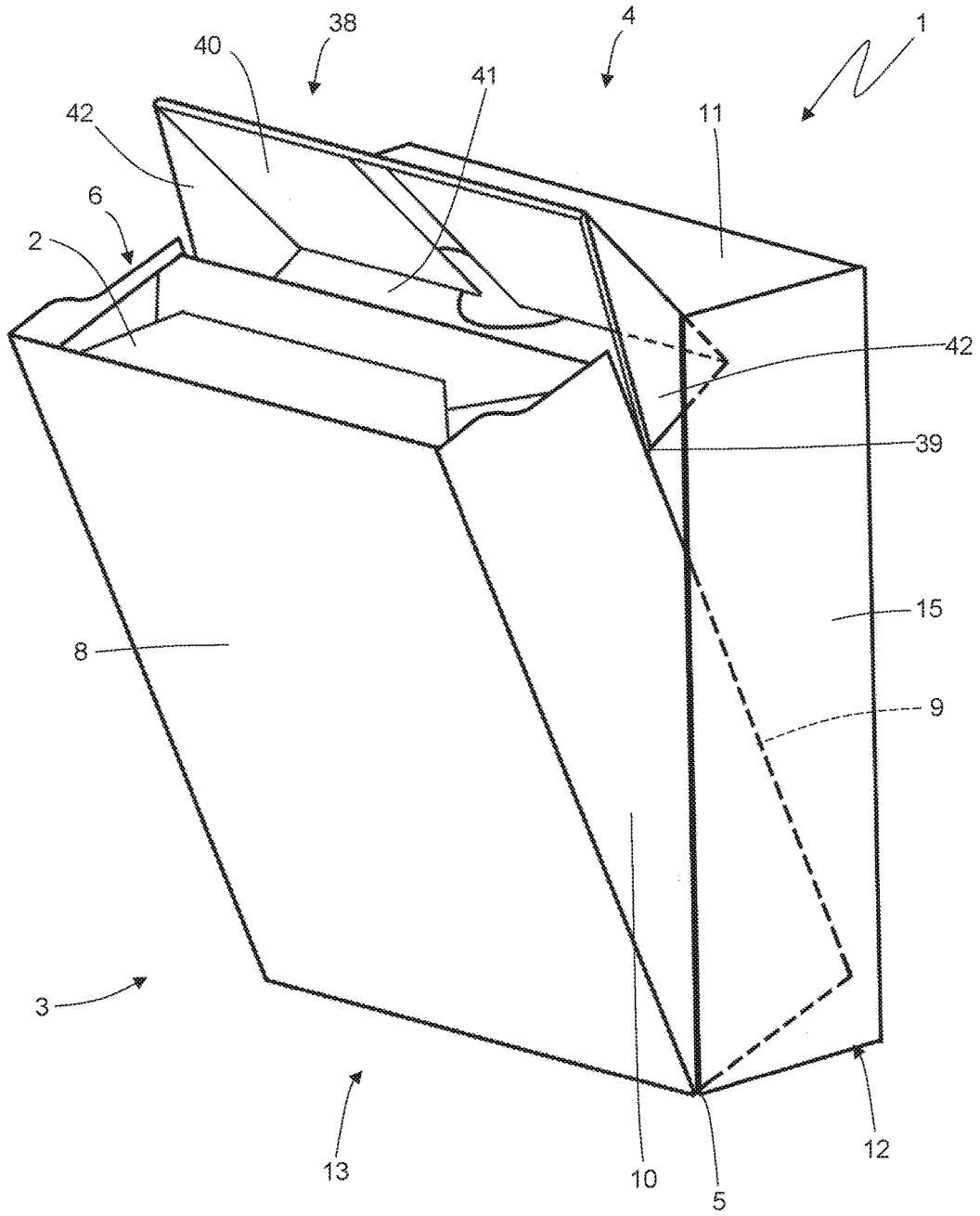
FIG. 34 is a front perspective view of a variant of the cigarette packet in FIG. 1 in an open configuration.
Figure 35:
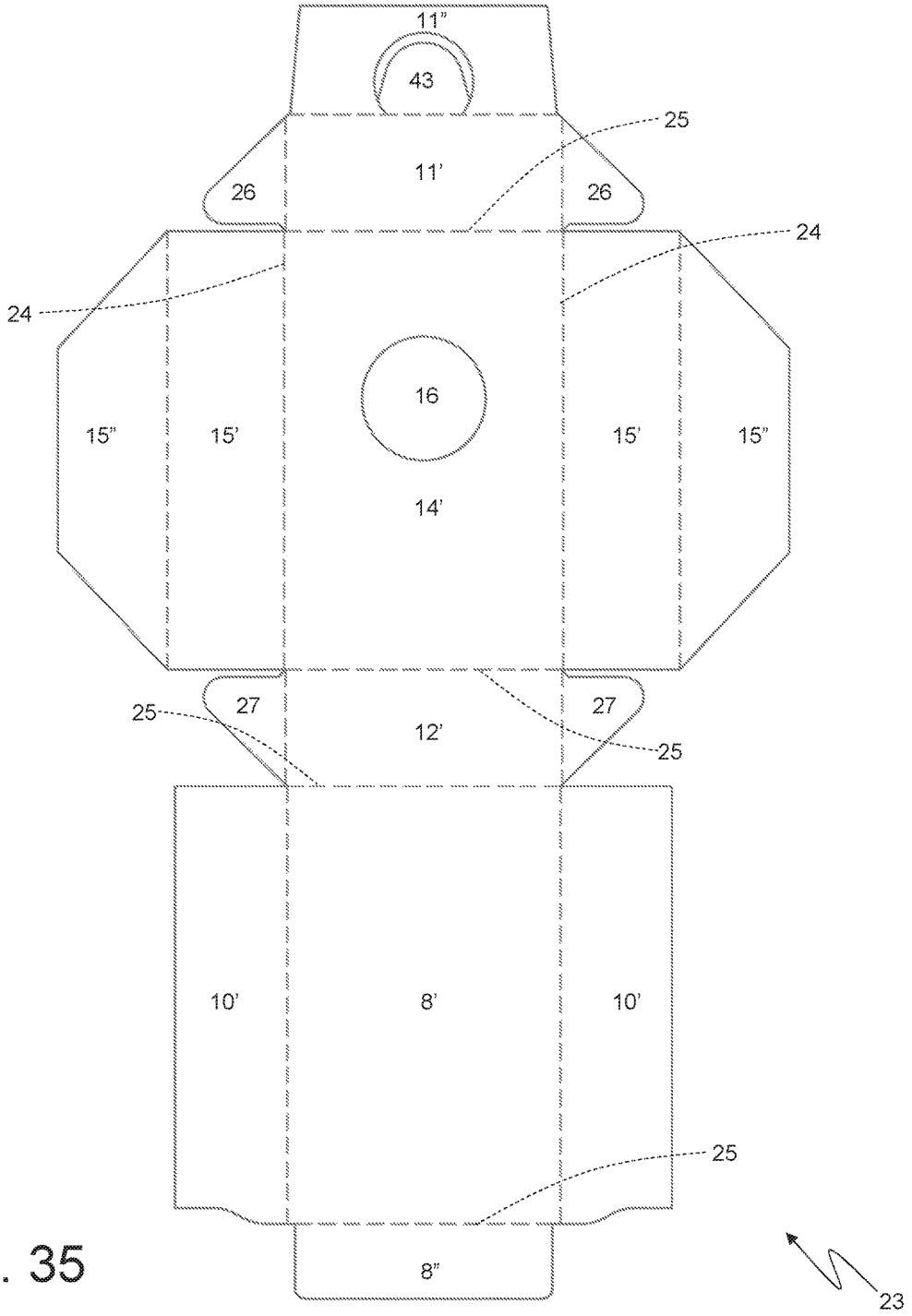
FIG. 35 is a plan view of a blank used to make an outer container and part of an inner container of the cigarette packet in FIG. 34.
Figure 36:
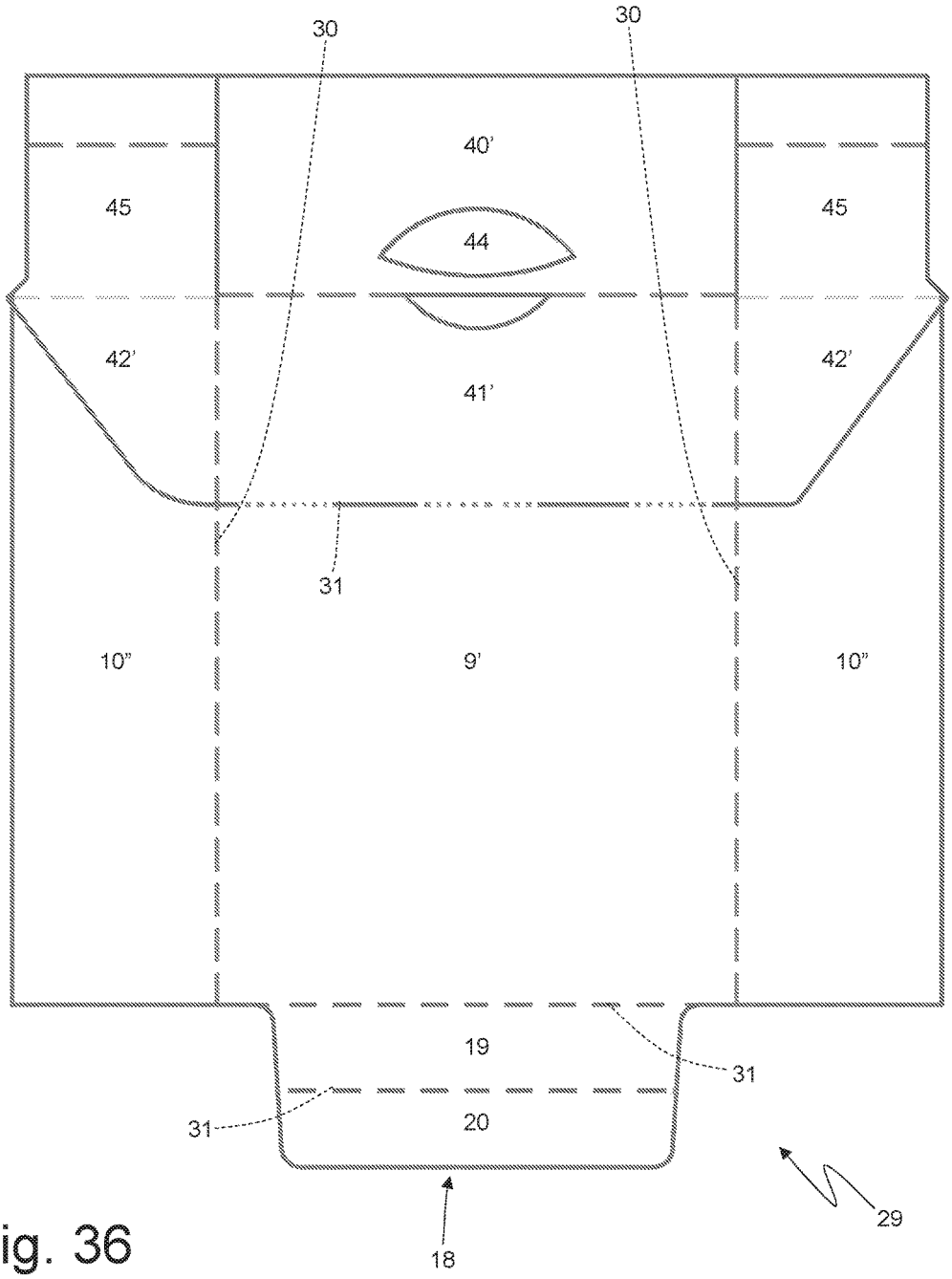
FIG. 36 is a plan view of a blank used to make part of an inner container of the cigarette packet in FIG. 34.

As shown in FIG. 36, the blank 29 used to make the inner container 3 shown in FIG. 34 is also provided with a panel 40' that forms the top wall 40 of the lid 38 and a panel 41' that forms the rear wall 41 of the lid 38. Panel 41' has a pair of wings 42' that form the lateral walls 42 of the lid 38 and which are arranged on opposite sides of the panel 41' and separated from panel 41' by longitudinal lines of weakness 30. Each wing 42' has a tab 45 which is folded 90° with respect to wing 42' and glued to the inside of panel 40'. The lid hinge 39 is formed by line of weakness 31, which separates panel 41' from panel 9' of blank 29.

Figure 37:
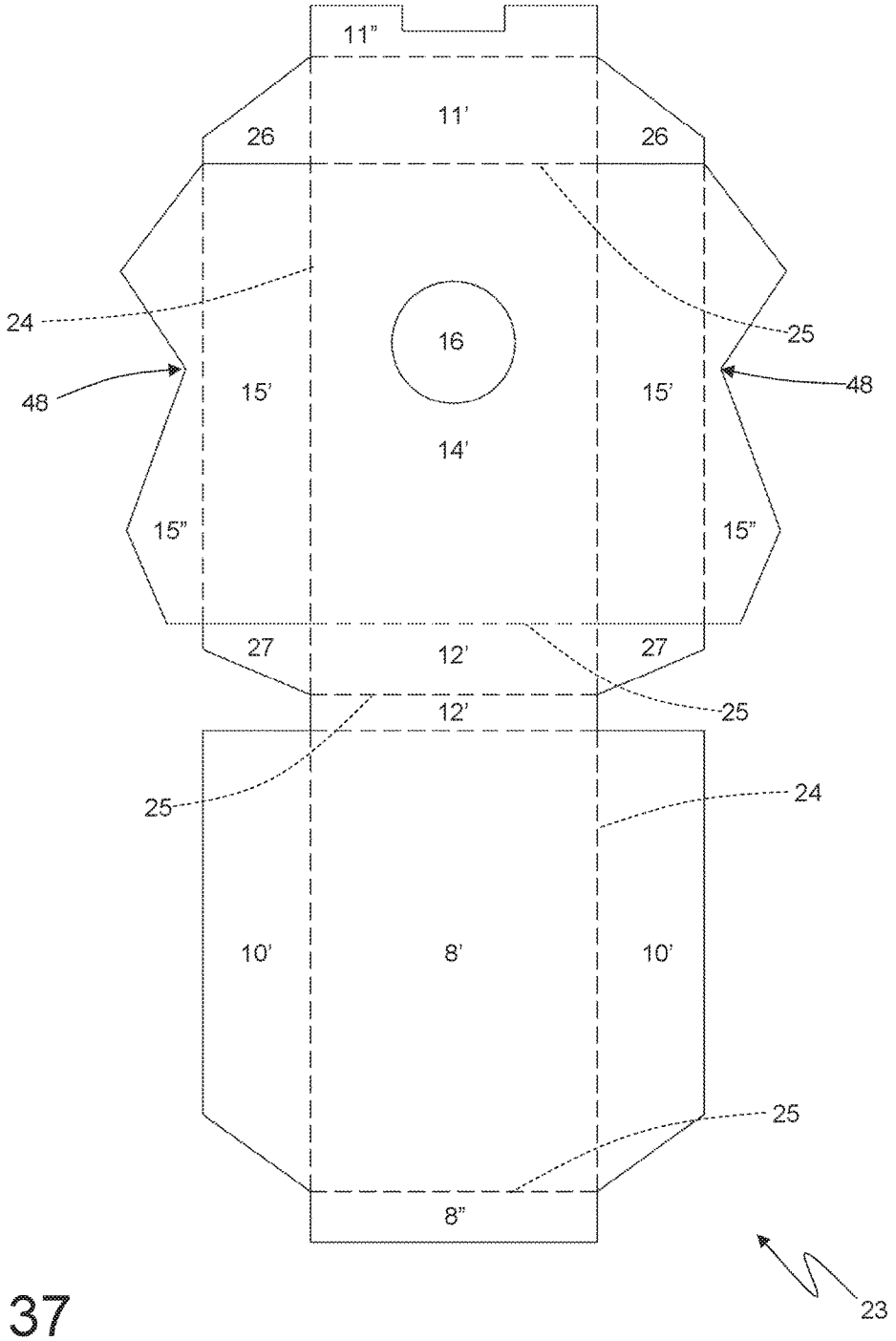
FIG. 37 is a plan view of a variant of the blank in FIG. 35.
Figure 38:
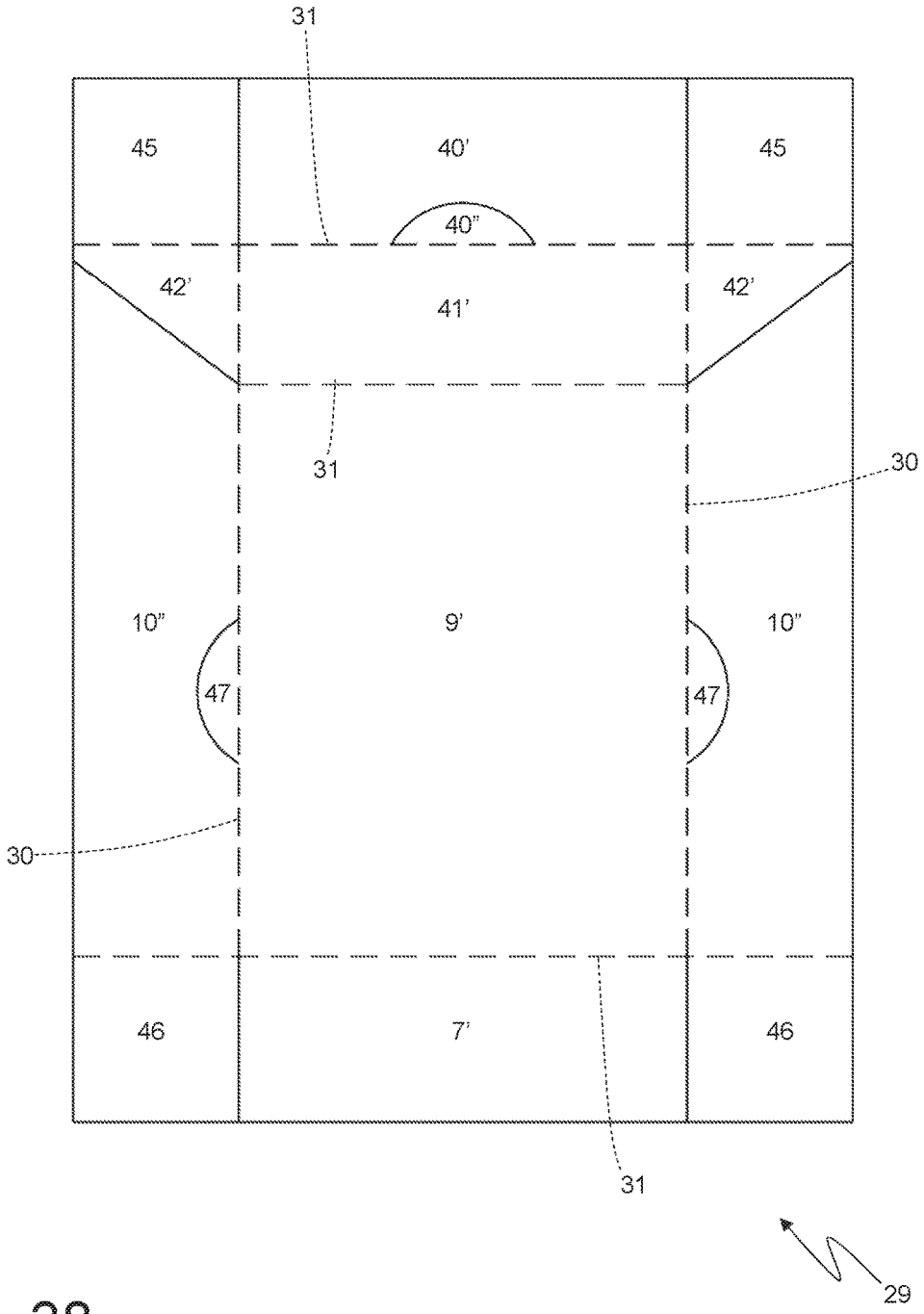
FIGS. 38 and 39 are two variants of the blank in FIG. 36.
Figure 39:
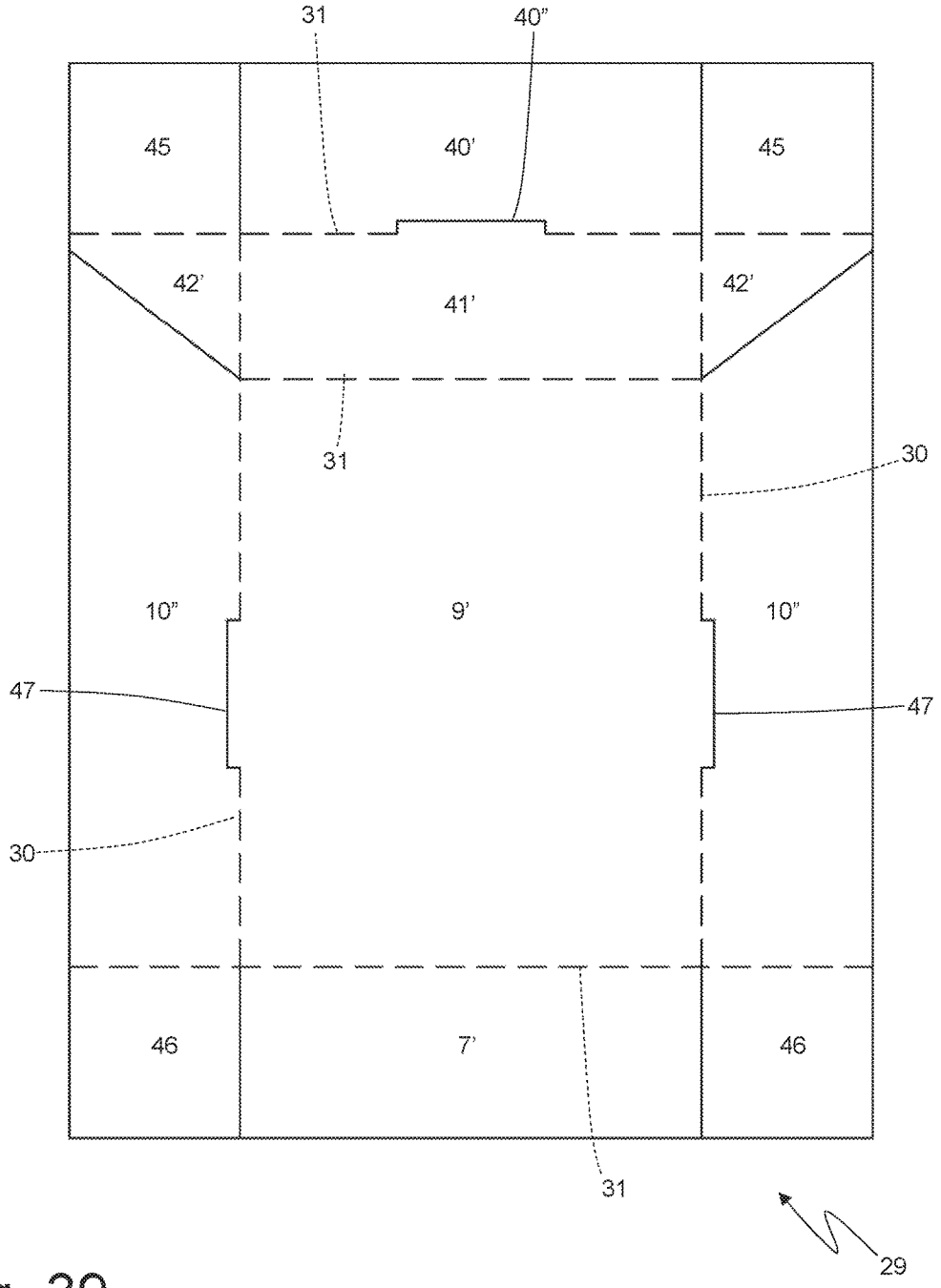

FIGS. 37, 38 and 39 show alternative embodiments of blanks 23 and 29, in which the stop tab 18 is absent and the bottom wall 7 of the inner container 3 is provided. In particular, as shown in FIGS. 38 and 39, the blank 29 used to make the inner container 3 is also provided with a panel 7' that forms the bottom wall 7 of the inner container 3; in addition, each wing 10" has a tab 46, which is folded 90° with respect to wing 10" and glued to the inside of panel 7'.

In the embodiments shown in FIGS. 37, 38 and 39, the stop tab 18 is absent and the stop member that limits extraction of the inner container 3 from the outer container 4 (and therefore establishes a fully-open position of the inner container 3 with respect to the outer container 4) comprises a pair of stop tabs 47 (shown in FIGS. 38 and 39), which project outwards from the inner container 3 (from the lateral walls 10 of the inner container 3) and are located near the rear wall 9 of the inner container 3; furthermore, the stop member comprises a pair of stop pockets 48 (shown in FIG. 37), which project inwards from the outer container 4 (from the lateral walls 15 of the outer container 4) and are located near the open front end 13 of the outer container 4. In use, when the inner container 3 rotates with respect to the outer container 4 about the main hinge 5 from the closed position towards the open position, each stop tab 47 enters a respective stop pocket 48 until it causes the extraction movement of the inner container 3 to stop. Furthermore, in the blanks 29 in FIGS. 38 and 39, there is a tab 40" made in panel 40' and hinged to panel 41' along a transverse line of weakness 31, and which is designed to engage in an opportune recess of panel 11" of blank 23 in FIG. 37.

Figure 40:
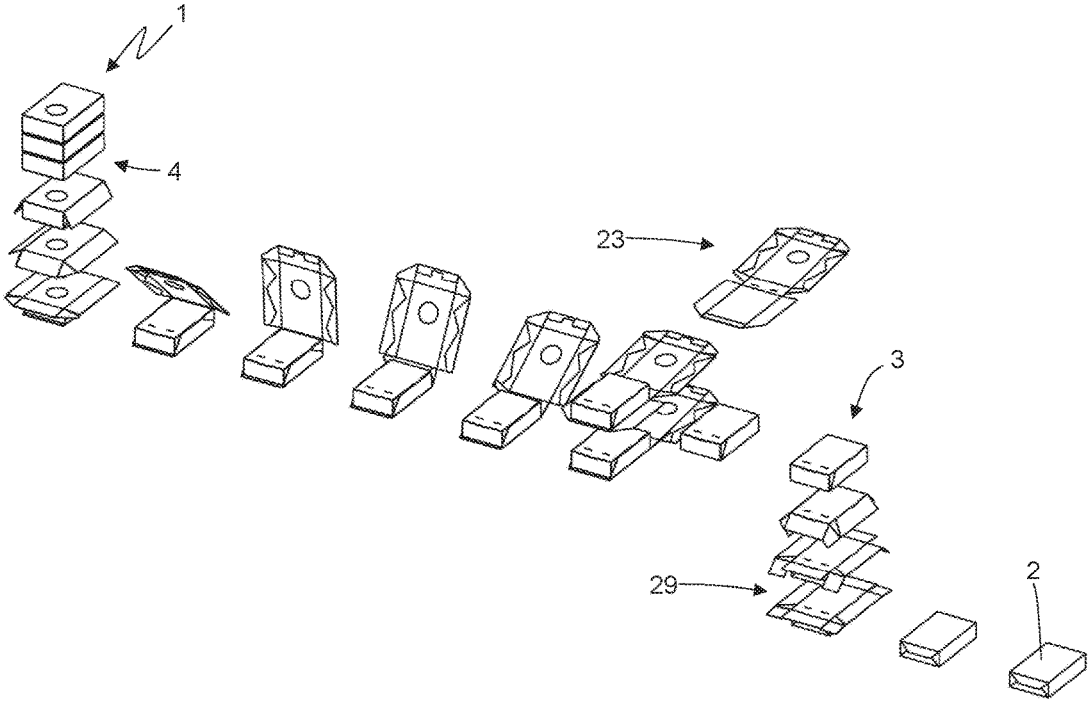
FIG. 40 is a schematic perspective view of the folding of the blanks in FIG. 37 and FIG. 38 or 39 to form the cigarette packet in FIG. 34.

FIG. 40 shows a schematic, perspective view of the folding of the blanks 23 and 29, respectively shown in FIG. 37 and in FIG. 38 or 39, to form the cigarette packet 1 shown in FIG. 34 (i.e. to form the inner container 3 and the outer container 4). In fact, the lines of weakness 24, 25, 30, 31 present in blanks 23 and 29 provide the fold lines between the corresponding adjacent panels comprised in blanks 23 and 29.

Figure 42:
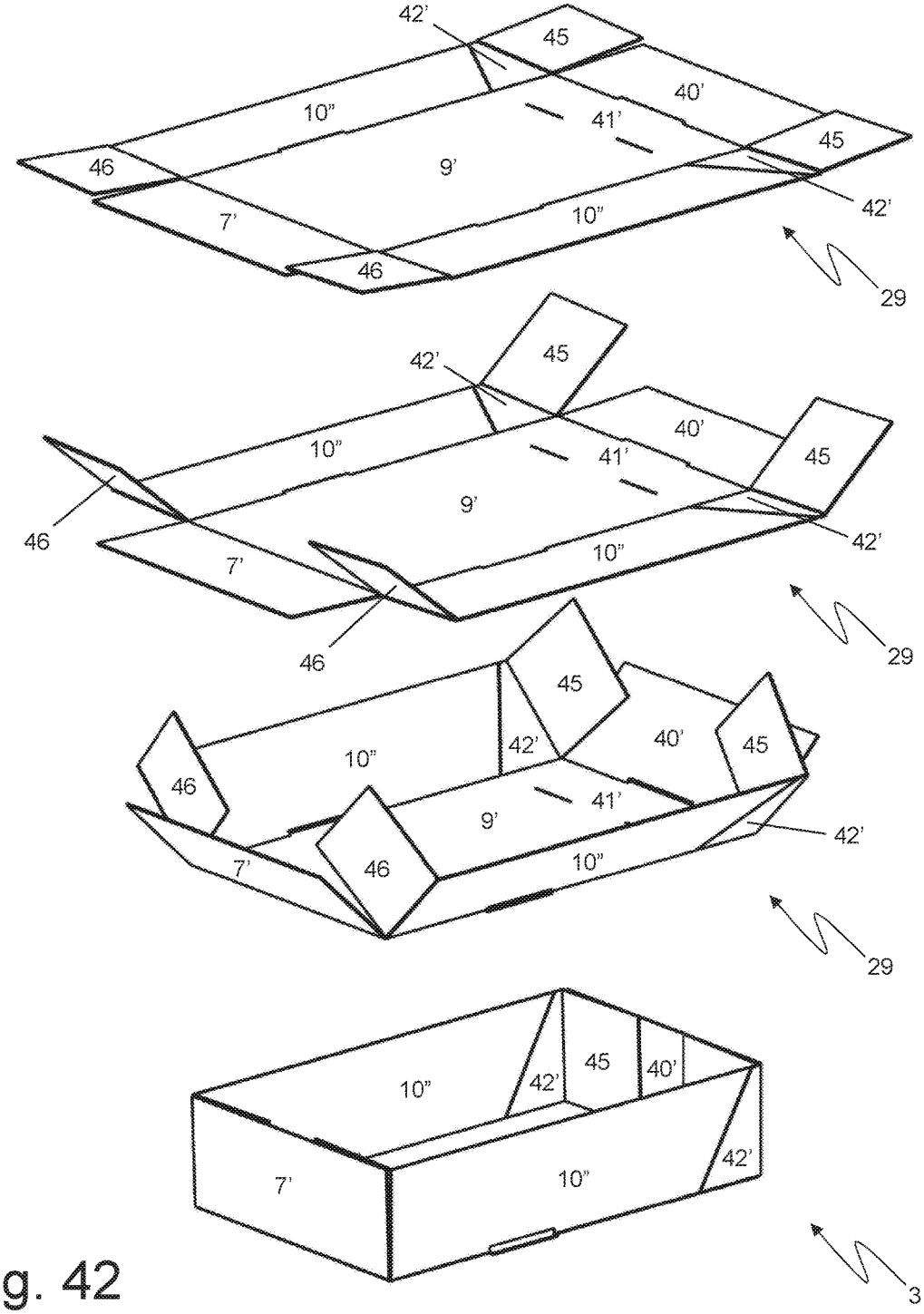
FIG. 42 is a view on an enlarged scale of a detail in FIG. 40 that shows the folding of the blank in FIG. 38 or FIG. 39.

As is better shown on an enlarged scale in FIG. 42, the folding of blank 29 envisages folding tabs 45 and 46 by 90° with respect to wings 10" and wings 42' about respective transverse lines of weakness 31, then folding wings 10" and 42' by 90° with respect to panel 9' about respective longitudinal lines of weakness 30, and, finally, folding panels 7' and 40' by 90° with respect to panels 9' and 41' about respective transverse lines of weakness 31. Before folding panels 7' and 40' by 90°, panels 7' and 40' or tabs 45 and 46 are gummed (i.e. glue applied) for gluing panel 7' to tabs 46 and panel 40' to tabs 45.

In the embodiment shown in FIG. 40, the wrapped group 2 of cigarettes is placed on panels 9' and 41' of blank 29 before beginning the above-described folding of the blank 29 and, consequently, blank 29 is folded around the wrapped group 2 of cigarettes (i.e. the inner container 3 is formed directly around the wrapped group 2 of cigarettes); according to a different embodiment, blank 29 is folded on its own (i.e. away from the wrapped group 2 of cigarettes) to form a cigarette container 3 that is only partially complete (without wings 10' that complete the lateral walls 10 and panel 8' that forms the front wall 8) and 'empty', and the wrapped group 2 of cigarettes is subsequently inserted inside the previously formed, partially complete cigarette container 3.

Figure 41:
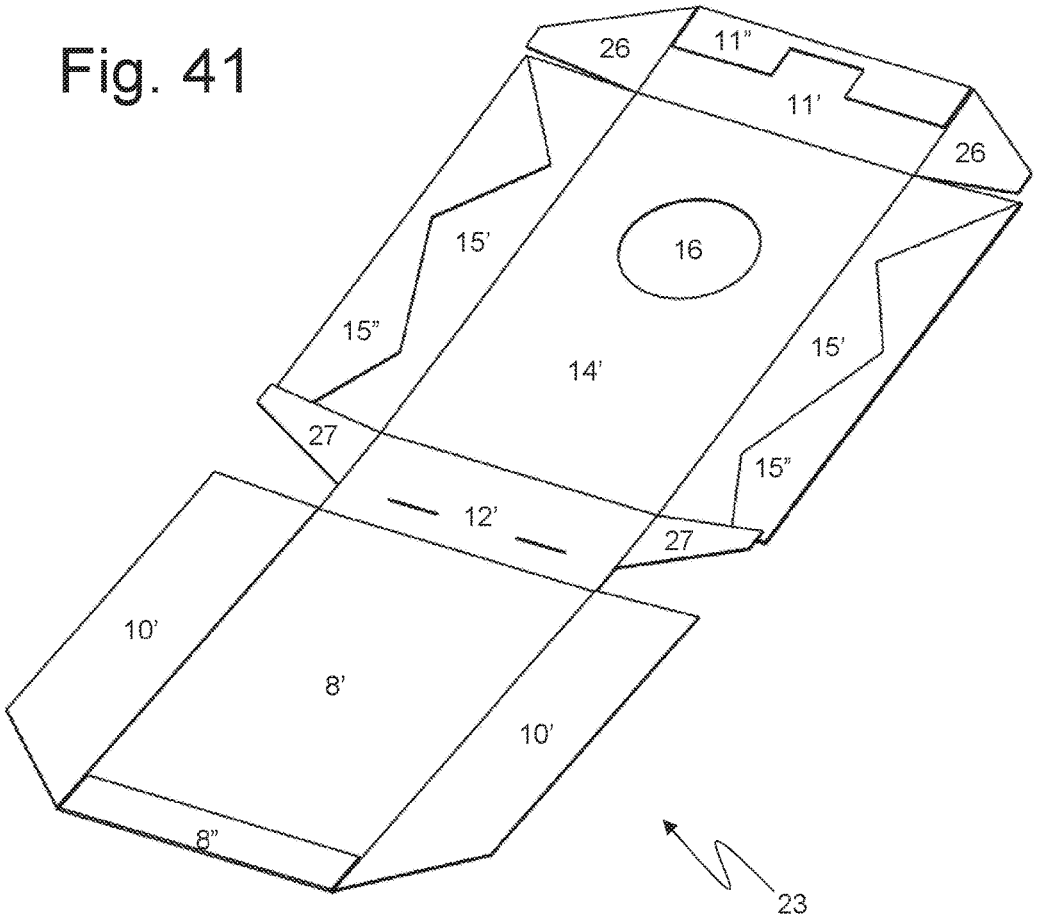
FIG. 41 is a view on an enlarged scale of a detail in FIG. 40 that shows the blank in FIG. 37 partially folded.

As is better shown on an enlarged scale in FIG. 41, blank 23 is initially pre-folded, by folding panel 11" by 180° and gluing it onto panel 11', folding panel 8" by 180° and gluing it onto panel 8', and folding wings 15" by 180° and gluing them onto wings 15'. Once the above-described pre-folding of blank 23 is terminated, the only partially complete inner container 3 (lacking the wings 10' that complete the lateral walls 10 and panel 8' that forms the front wall 8) is placed on panel 8' of the pre-folded blank 23 and the folding of blank 23 around the only partially complete inner container 3 commences to complete the forming of the inner container 3 and then the forming of the outer container 4, thus completing the construction of the cigarette packet 1.

Initially, the wings 10' are folded 90° with respect to panel 8' about respective longitudinal lines of weakness 24 so as be superimposed on wings 10" of blank 29 and therefore complete the formation of the inner container 3 by completing the formation of the lateral walls 10 of the inner container 3; before superimposing wings 10' of blank 23 on wings 10" of blank 29 to form the lateral walls 10 of the inner container 3, the wings 10' or wings 10" are gummed (i.e. glue applied).

Then, panel 12' of blank 23 is folded 90° with respect to panel 8' and about a respective transverse line of weakness 25 to be placed in contact with panel 7' of blank 29; before superimposing panel 12' of blank 23 on panel 7' of blank 29, panel 7' or panel 12' are gummed (i.e. glue applied). Obviously, if panel 7' of blank 29 is absent, panel 12' of blank 23 is not gummed. Immediately after (or at the same time as) folding panel 12' of blank 23, the tabs 27 arranged on opposite sides of panel 12' of blank 23 are folded 90° with respect to panel 12' about respective longitudinal lines of weakness 24 so as to rest (without the interposition of glue) on the previously folded wings 10'.

At this point, panel 14' of blank 23 is folded 90° with respect to panel 12' about a respective transverse line of weakness 25 to become placed in contact with panel 9' of blank 29. Then, panel 11' of blank 23 is folded 90° with respect to panel 14' about a respective transverse line of weakness 25 to rest (without the interposition of glue) on panel 40' of blank 29. Immediately after (or at the same time as) folding panel 11' of blank 23, the tabs 26 arranged on opposite sides of panel 11' of blank 23 are folded 90° with respect to panel 11' about respective longitudinal lines of weakness 24 so as to rest (without the interposition of glue) on the previously folded wings 10'.

Finally, wings 15' of blank 23 are folded 90° with respect to panel 14' about respective longitudinal lines of weakness 24 so as to rest (without the interposition of glue) on wings 10' of blank 23 and (with the interposition of glue) on tabs 26 and 27 of previously folded blank 23; before superimposing wings 15' of blank 23 on tabs 26 and 27 of blank 23 to form the lateral walls 15 of the outer container 4, wings 15' or tabs 26 and 27 are gummed (i.e. glue applied) to cause gluing of wings 15' to tabs 26 and 27 (instead, absolutely no glue is interposed between wings 15' of blank 23 and wings 10' of blank 23).

FIGS. 40-42 refer to the previously described folding methods for the blanks 23 and 29 shown respectively in FIG. 37 and in FIG. 38 or 39; it is important to underline that the same folding methods are also applied to the other previously described embodiments of blanks 23 and 29.

Figure 43:
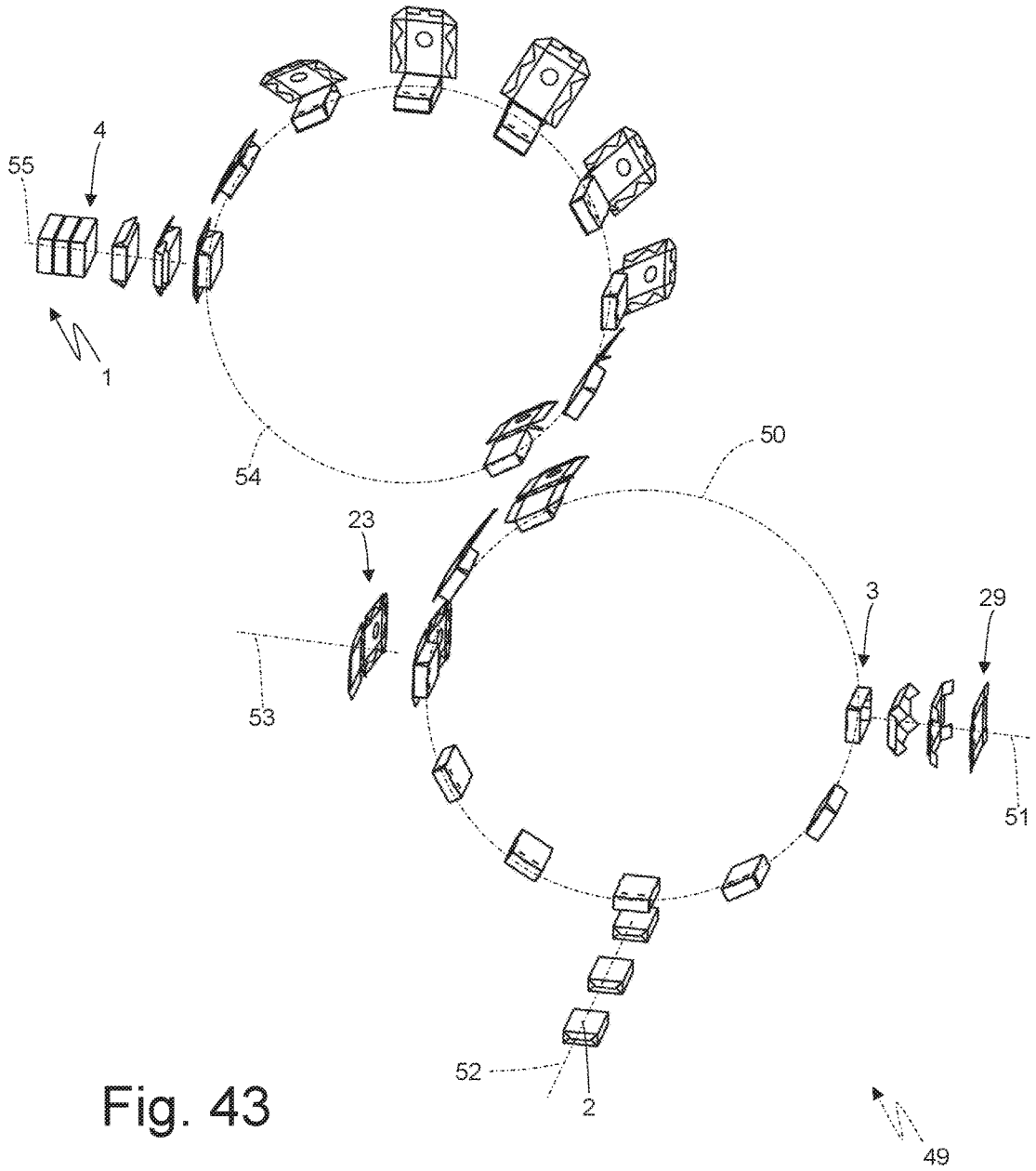
FIG. 43 is a schematic perspective view of the folding of the blanks in FIG. 37 and in FIG. 38 or 39 to form the cigarette packet in FIG. 34 in a first packing machine.

FIG. 43 schematically shows a packing machine 49 that makes the cigarette packets 1 by folding the blanks 23 and 29 shown respectively in FIG. 37 and in FIG. 38 or 39 around a wrapped groups 2 of cigarettes according to the folding methods described in the foregoing and schematically shown in FIG. 40 (as already stated, the same folding methods are also applied to the other previously described embodiments of blanks 23 and 29).

Packing machine 49 comprises a wrapping wheel 50 with a horizontal axis of rotation (i.e. arranged vertically) that receives blanks 29 from a feed conveyor 51, the folding of which is completed (folded into a receptacle) at the moment of entering the pockets of the wrapping wheel 50; in other words, the folding of each blank 29 starts along feed conveyor 51 and is completed (with the folding of wings 10" and panels 7' and 41' by 90° with respect to panel 9') at the moment of entering a pocket of the wrapping wheel 50. Therefore, downstream of the feed conveyor 51 the pockets of the wrapping wheel 50 hold corresponding inner containers 3 that are empty and partially complete (lacking wings 10' that complete the lateral walls 10 and panel 8' that forms the front wall 8).

A feed conveyor 52 arranged downstream of feed conveyor 51 with respect to the rotation of the wrapping wheel 50 feeds the wrapped groups 2 of cigarettes to the wrapping wheel 50, which are then inserted into the corresponding inner containers 3 that are only partial complete (lacking wings 10' that complete the lateral walls 10 and panel 8' that forms the front wall 8) and empty.

A feed conveyor 53 arranged downstream of feed conveyor 52 with respect to the of rotation of the wrapping wheel 50 feeds the pre-folded blanks 23 to the wrapping wheel 50 (as shown in FIG. 41), which then rest on the only partially complete inner containers 3.

Packing machine 49 comprises a wrapping wheel 54 with a horizontal axis of rotation (i.e. arranged vertically) that receives the (only partially complete) inner containers 3 paired with corresponding blanks 23 from wrapping wheel 50 in a transfer station. When a blank 23 together with an (only partially complete) inner container 3 enters a pocket of the wrapping wheel 54, the folding of wings 10' of blank 23 around the inner container 3 is performed; then, between the transfer station between the two wrapping wheels 50 and 54 and an output conveyor 55, each blank 23 is further folded by folding panel 12' with respect to panel 8', folding tabs 27 with respect to panel 12' and folding panel 14' with respect to panel 12'. On leaving a pocket of wrapping wheel 54 for the output conveyor 55, the folding of each blank 23 is complete by folding panel 11' with respect to panel 14', folding tabs with respect to panel 11' and folding wings 15' with respect to panel 14'.

Figure 44:
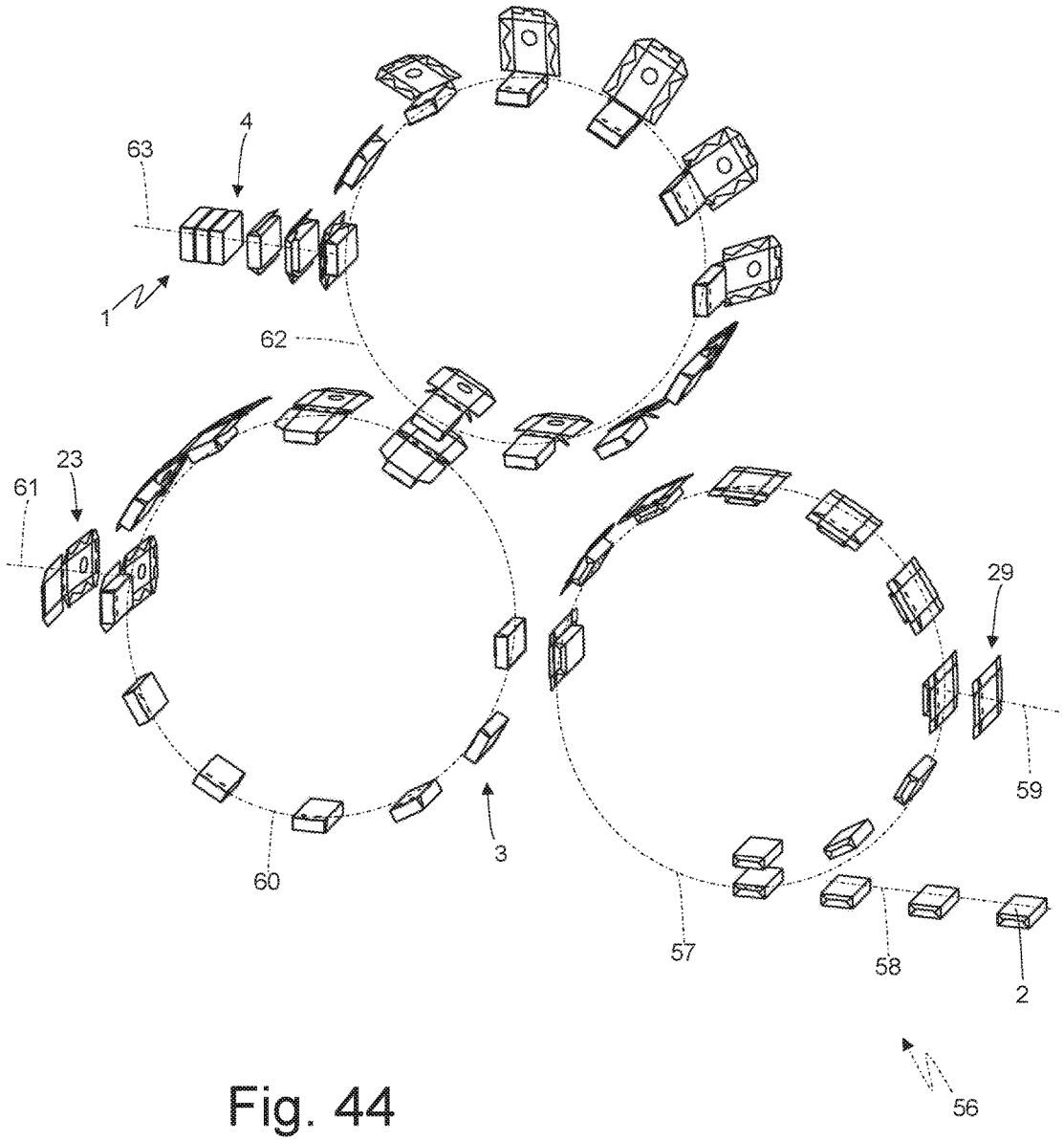
FIG. 44 is a schematic perspective view of the folding of the blanks in FIG. 37 and in FIG. 38 or 39 to form the cigarette packet in FIG. 34 in a second packing machine.

FIG. 44 schematically shows a packing machine 56 that makes the cigarette packets 1 by folding the blanks 23 and 29 shown respectively in FIG. 37 and in FIG. 38 or 39 around a wrapped groups 2 of cigarettes according to the folding methods described in the foregoing and schematically shown in FIG. 40 (as already stated, the same folding methods are also applied to the other previously described embodiments of blanks 23 and 29).

Packing machine 56 comprises a wrapping wheel 57 with a horizontal axis of rotation (i.e. arranged vertically) that receives wrapped groups 2 of cigarettes from a feed conveyor 58 and blanks 29 from a feed conveyor 59 (arranged downstream of the feed conveyor 58 with respect to the of rotation of the wrapping wheel 57). For each blank 29, tabs 45 and 46 are folded 90° with respect to wings 10" on the wrapping wheel 57. Packing machine 56 comprises a wrapping wheel 60 with a horizontal axis of rotation (i.e. arranged vertically) that receives wrapped groups 2 of cigarettes paired with blanks 29 from wrapping wheel 57 in a transfer station; the folding of each blank 29 starts along the wrapping wheel 57 and is completed (with folding of the of wings 10" and panels 7' and 41' by 90° with respect to panel 9') at the moment of entering a pocket of the wrapping wheel 60 (i.e. completed in the transfer station between wrapping wheels 57 and 60). Then, downstream of the transfer station between wrapping wheels 57 and 60, the pockets of the wrapping wheel 60 hold corresponding inner containers 3 provided with wrapped groups 2 of cigarettes and only partially completed (lacking wings 10' that complete the lateral walls 10 and panel 8' that forms the front wall 8).

A feed conveyor 61 arranged downstream of the transfer station between wrapping wheels 57 and 60, with respect to the of rotation of the wrapping wheel 60, feeds the pre-folded blanks 23 to the wrapping wheel 60 (as shown in FIG. 41), which then rest on the only partially complete inner containers 3.

Packing machine 56 comprises a wrapping wheel 62 with a horizontal axis of rotation (i.e. arranged vertically) that receives the only partially complete inner containers 3 paired with corresponding blanks 23 from the wrapping wheel 60 in a transfer station. When a blank 23 together with an (only partially complete) inner container 3 enters a pocket of the wrapping wheel 62, the folding of wings 10' of blank 23 is performed; then, between the transfer station between the two wrapping wheels 60 and 62 and an output conveyor 63, each blank 23 is further folded by folding panel 12' with respect to panel 8', folding tabs 27 with respect to panel 12' and folding panel 14' with respect to panel 12'. On leaving a pocket of wrapping wheel 62 for the output conveyor 63, the folding of each blank 23 is completed by folding panel 11' with respect to panel 14', folding tabs 26 with respect to panel 11' and folding wings 15' with respect to panel 14'.

Figure 45:
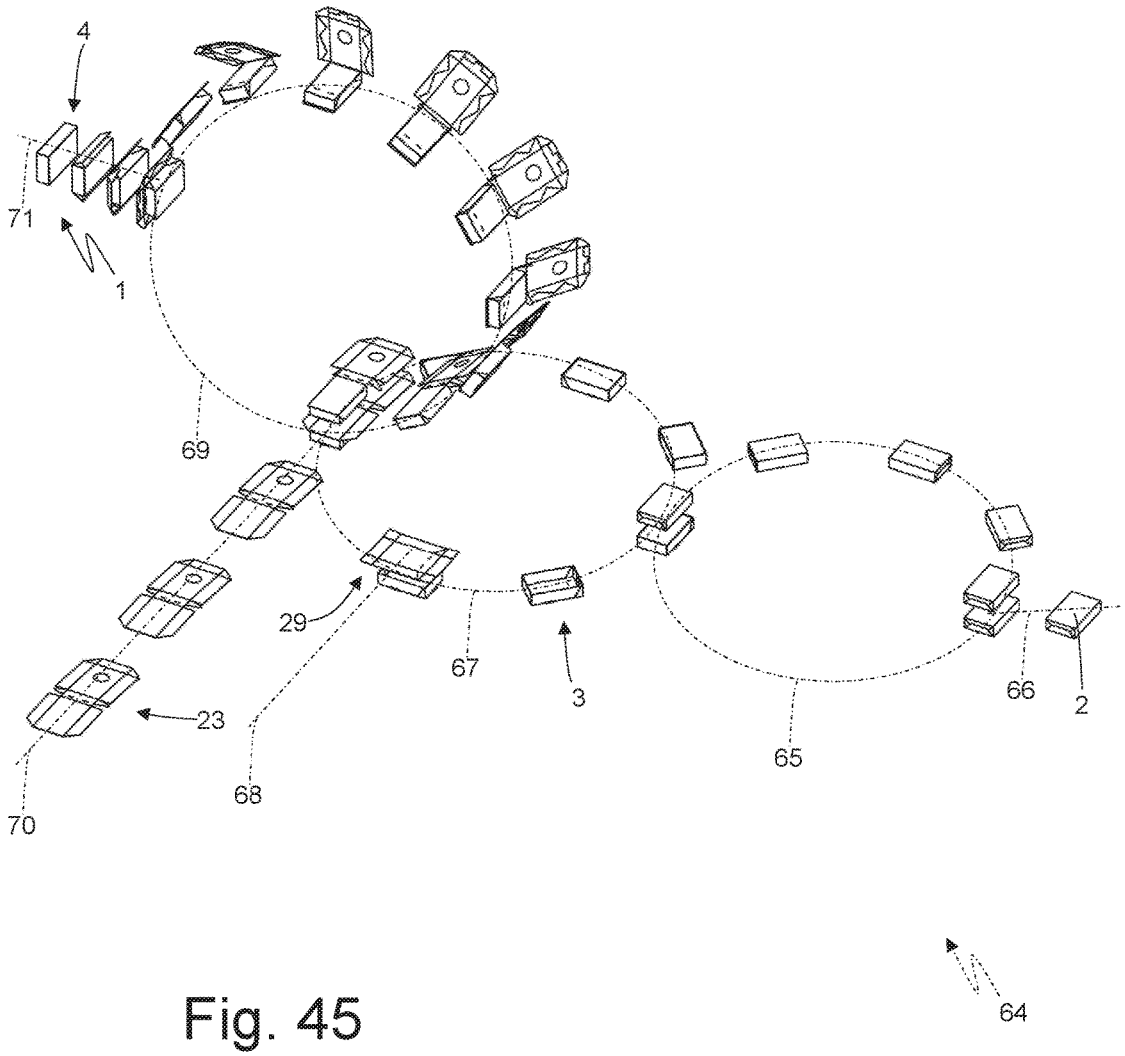
FIG. 45 is a schematic perspective view of the folding of the blanks in FIG. 37 and in FIG. 38 or 39 to form the cigarette packet in FIG. 34 in a third packing machine.

FIG. 45 schematically shows a packing machine 64 that makes the cigarette packets 1 by folding the blanks 23 and 29 shown respectively in FIG. 37 and in FIG. 38 or 39 around a wrapped groups 2 of cigarettes according to the folding methods described in the foregoing and schematically shown in FIG. 40 (as already stated, the same folding methods are also applied to the other previously described embodiments of blanks 23 and 29).

Packing machine 64 comprises a wrapping wheel 65 with a vertical axis of rotation (i.e. arranged horizontally) that receives wrapped groups 2 of cigarettes from a feed conveyor 66, and a wrapping wheel 67 with a vertical axis of rotation (i.e. arranged horizontally) that receives wrapped groups 2 of cigarettes from wrapping wheel 65 in a corresponding transfer station.

Wrapping wheel 67 receives blanks 29 from a feed conveyor 68, the folding of which is completed (folded into a receptacle) at the moment of entering the pockets of the wrapping wheel 67; in other words, the folding of each blank 29 starts along feed conveyor 68 and is completed (with the folding of wings 10" and panels 7' and 41' by 90° with respect to panel 9') at the moment of entering a pocket of the wrapping wheel 67. Therefore, downstream of the feed conveyor 68 the pockets of the wrapping wheel 67 hold corresponding inner containers 3 that are empty and only partially complete (lacking wings 10' that complete the lateral walls 10 and panel 8' that forms the front wall 8).

The transfer station between wrapping wheels 65 and 67 is arranged downstream of the feed conveyor 68 with respect to the of rotation of the wrapping wheel 67 and feeds the wrapped groups 2 of cigarettes to the wrapping wheel 67, which are then inserted into the corresponding inner containers 3 that are only partial complete (lacking wings 10' that complete the lateral walls 10 and panel 8' that forms the front wall 8) and empty.

Packing machine 64 comprises a wrapping wheel 69 with a horizontal axis of rotation (i.e. arranged vertically) that receives the only partially complete inner containers 3 housing the wrapped groups 2 of cigarettes from wrapping wheel 67 in a transfer station. In the transfer station between wrapping wheels 67 and 69, a feed conveyor 70 feeds pre-folded blanks 23 (as shown in FIG. 41) that are paired with the inner containers 3, which are only partially complete and house the groups 2 of cigarettes, during transfer from wrapping wheel 67 to wrapping wheel 69.

When a blank 23 together with an inner container 3 enters a pocket of the wrapping wheel 69, the folding of wings 10' of blank 23 is performed; then, between the transfer station between the two wrapping wheels 67 and 69 and an output conveyor 71, each blank 23 is further folded by folding panel 12' with respect to panel 8', folding tabs 27 with respect to panel 12' and folding panel 14' with respect to panel 12'. On leaving a pocket of wrapping wheel 69 for the output conveyor 71, the folding of each blank 23 is completed by folding panel 11' with respect to panel 14', folding tabs 26 with respect to panel 11' and folding wings 15' with respect to panel 14'.

Figure 46:
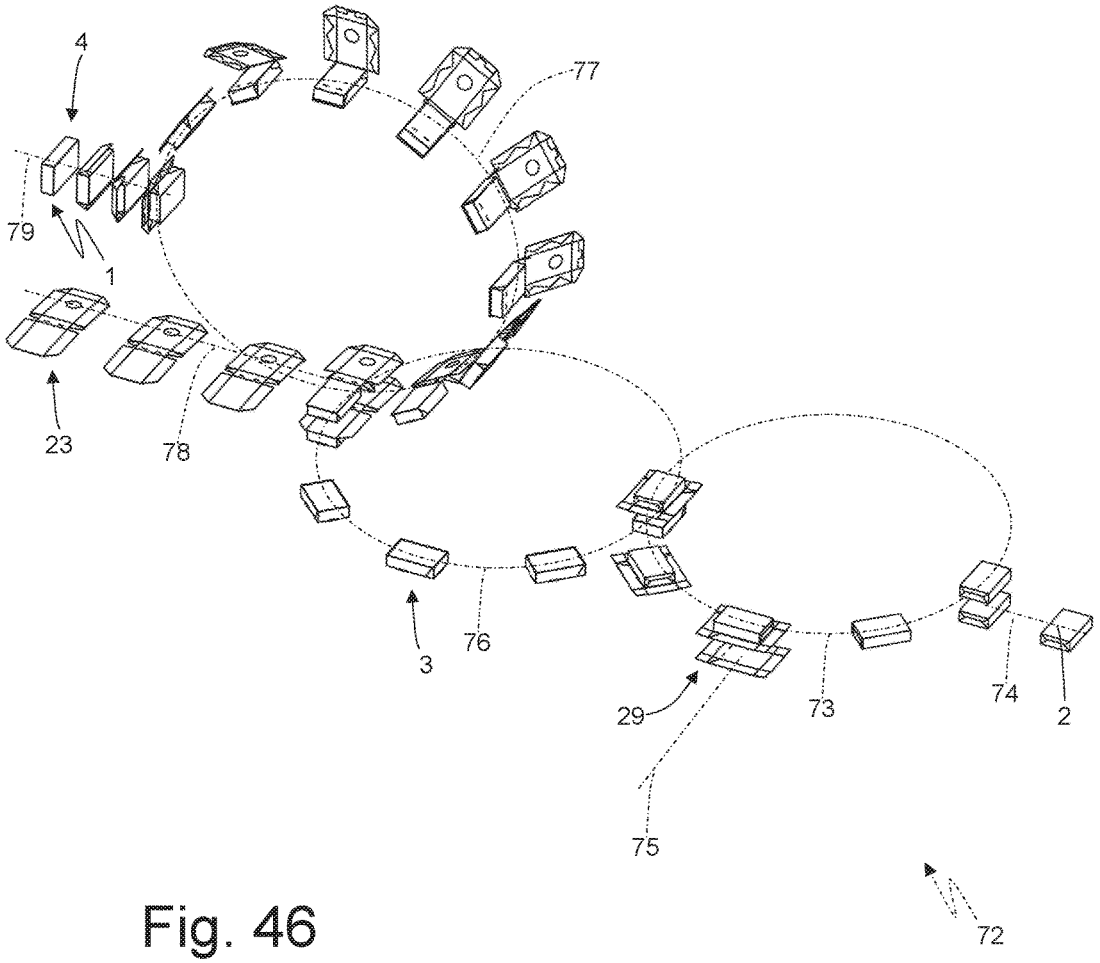
FIG. 46 is a schematic perspective view of the folding of the blanks in FIG. 37 and in FIG. 38 or 39 to form the cigarette packet in FIG. 34 in a fourth packing machine.

FIG. 46 schematically shows a packing machine 72 that makes the cigarette packets 1 by folding the blanks 23 and 29 shown respectively in FIG. 37 and in FIG. 38 or 39 around a wrapped groups 2 of cigarettes according to the folding methods described in the foregoing and schematically shown in FIG. 40 (as already stated, the same folding methods are also applied to the other previously described embodiments of blanks 23 and 29).

Packing machine 72 comprises a wrapping wheel 73 with a vertical axis of rotation (i.e. arranged horizontally) that receives wrapped groups 2 of cigarettes from a feed conveyor 74 and receives blanks 29 from a feed conveyor 75 (arranged downstream of the feed conveyor 74 with respect to the of rotation of the wrapping wheel 73). For each blank 29, tabs 45 and 46 are folded 90° with respect to wings 10" on the wrapping wheel 73.

Packing machine 72 comprises a wrapping wheel 76 with a vertical axis of rotation (i.e. arranged horizontally) that receives wrapped groups 2 of cigarettes paired with blanks 29 from wrapping wheel 73 in a transfer station; the folding of each blank 29 starts along the wrapping wheel 73 and is completed (with the folding of wings 10" and panels 7' and 41' by 90° with respect to panel 9') at the moment of entering a pocket of the wrapping wheel 76 (i.e. completed in the transfer station between wrapping wheels 73 and 76). Then, downstream of the transfer station between wrapping wheels 73 and 76, the pockets of the wrapping wheel 76 hold corresponding inner containers 3 provided with wrapped groups 2 of cigarettes and only partially completed (lacking wings 10' that complete the lateral walls 10 and panel 8' that forms the front wall 8).

Packing machine 72 comprises a wrapping wheel 77 with a horizontal axis of rotation (i.e. arranged vertically) that receives the inner containers 3, which are only partially complete and house the wrapped groups 2 of cigarettes from wrapping wheel 76, in a transfer station. In the transfer station between wrapping wheels 76 and 77, a feed conveyor 78 feeds pre-folded blanks 23 (as shown in FIG. 41) that are paired to the inner containers 3, which are only partially complete and house the groups 2 of cigarettes, during transfer from wrapping wheel 76 to wrapping wheel 76.

When a blank 23 together with an inner container 3 enters a pocket of the wrapping wheel 77 the folding of wings 10' of blank 23 is performed; then, between the transfer station between the two wrapping wheels 76 and 77 and an output conveyor 79, each blank 23 is further folded by folding panel 12' with respect to panel 8', folding tabs 27 with respect to panel 12' and folding panel 14' with respect to panel 12'. On leaving a pocket of wrapping wheel 77 for the output conveyor 79, the folding of each blank 23 is completed by folding panel 11' with respect to panel 14', folding tabs 26 with respect to panel 11' and folding wings 15' with respect to panel 14'.

Figure 47:
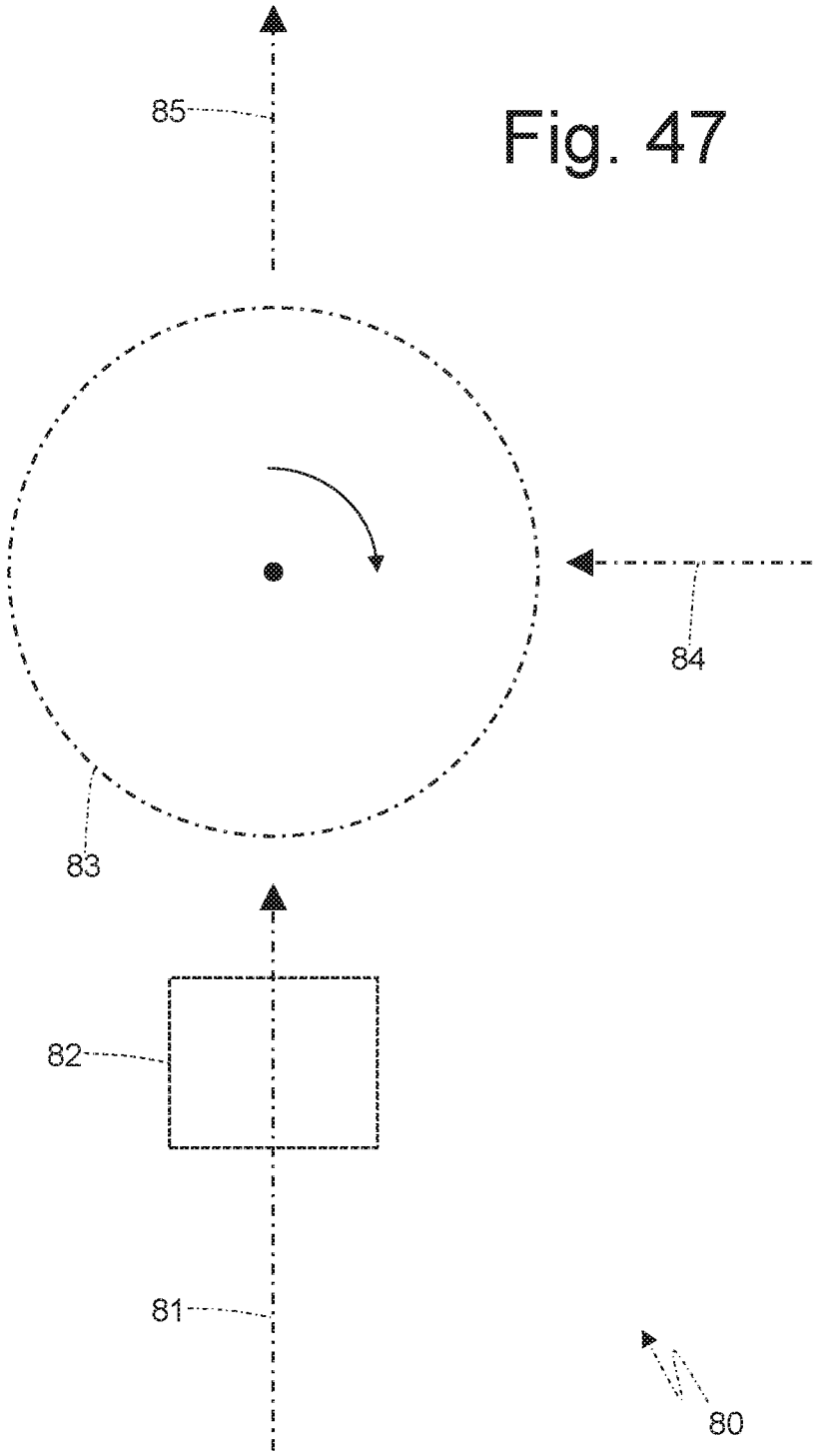
FIG. 47 is a schematic plan view of a fifth packing machine that folds the blanks in FIG. 37 and in FIG. 38 or 39 to form the cigarette packet in FIG. 34.

FIG. 47 schematically shows a packing machine 80 that makes the cigarette packets 1 by folding the blanks 23 and 29 shown respectively in FIG. 37 and in FIG. 38 or 39 around a wrapped groups 2 of cigarettes according to the folding methods described in the foregoing and schematically shown in FIG. 40 (as already stated, the same folding methods are also applied to the other previously described embodiments of blanks 23 and 29).

Packing machine 80 comprises a belt-type wrapping conveyor 81 that feeds wrapped groups 2 of cigarettes along a horizontal rectilinear path. A feed conveyor 82 is positioned along the path of the wrapping conveyor 81 and arranged above the wrapping conveyor 81 for feeding each blank 29 top-down, placing the blank 29 on top of the corresponding wrapped group 2 of cigarettes (as clearly shown in FIG. 48). The folding of the blanks 29 is completed when each blank 29 is placed on top of the corresponding wrapped group 2 of cigarettes; therefore, downstream of the feed conveyor 82, the pockets of the wrapping conveyor 81 hold corresponding inner containers 3 that house the wrapped groups 2 of cigarettes and are partially complete (lacking wings 10' that complete the lateral walls 10 and panel 8' that forms the front wall 8).

Figure 48:
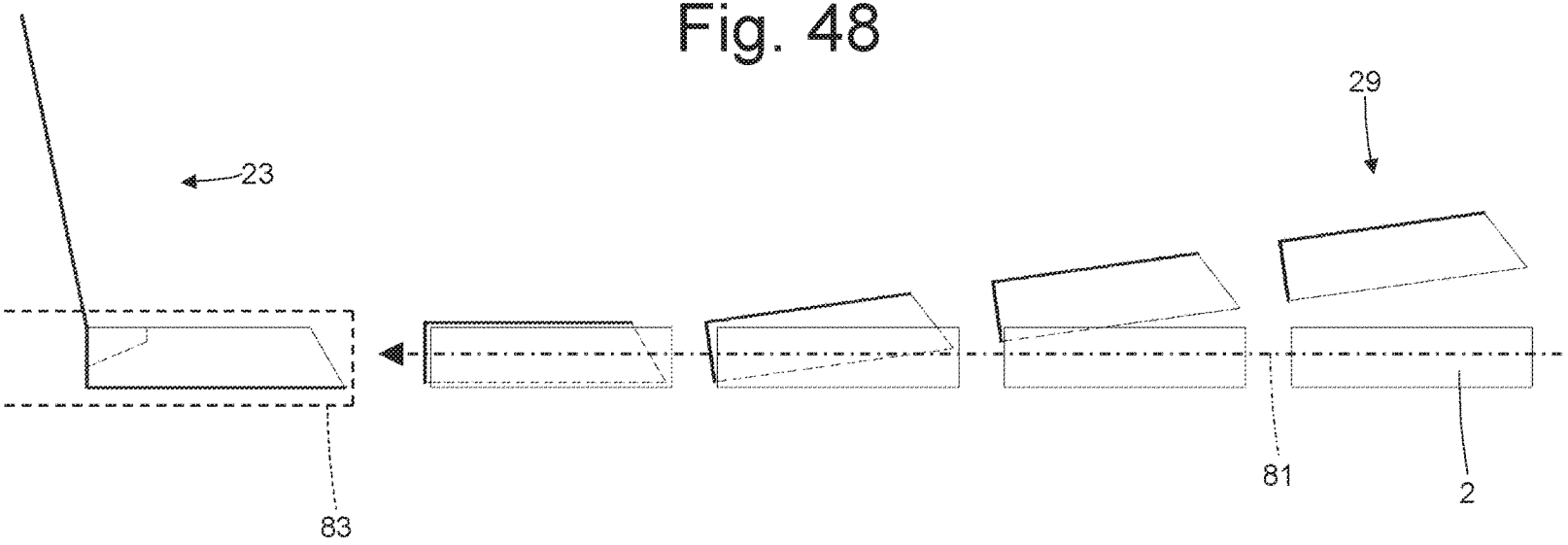
FIG. 48 is a schematic lateral view of the folding of the blanks in FIG. 37 and in FIG. 38 or 39 in the fifth packing machine of FIG. 47.

Packing machine 80 also comprises a wrapping wheel 83 with a vertical axis of rotation (i.e. arranged horizontally) that receives blanks 23 from a feed conveyor 84 upstream of the wrapping conveyor 81. Each blank 23 is inserted inside a pocket of the wrapping wheel 83, consequently being folded into an 'L' by folding wings 10' with respect to panel 8', folding panel 12' with respect to panel 8' and folding tabs 27 with respect to panel 12' (as shown in FIG. 48). Then, in a transfer station, a corresponding wrapped group 2 of cigarettes wrapped in a blank 29 is radially inserted in the pocket of the wrapping wheel 83, coupling with the blank 23 contained therein. Then, between the transfer station between the wrapping conveyor 81 and the wrapping wheel 83 and an output conveyor 85, each blank 23 is further folded by folding panel 14' with respect to panel 12'. On leaving a pocket of wrapping wheel 83 for the output conveyor 85, the folding of each blank 23 is completed by folding panel 11' with respect to panel 14', folding tabs 26 with respect to panel 11' and folding wings 15' with respect to panel 14'.

The cigarette packet 1 described in the foregoing with reference to the embodiments shown in FIGS. 1-17 has a stop member that is, at the same time, very effective (i.e. capable of smoothly and precisely stopping the extraction movement of the inner container 3 from the outer container 4), very efficient (i.e. enables achieving a smooth and natural rotary movement of the inner container 3 in any position), and simple and inexpensive to manufacture (in fact, the stop member is constituted entirely by a single stop tab 18).

The folding methods for blanks 23 and 29 described in the foregoing with reference to that shown in FIGS. 40-48 have numerous advantages, as they allow making cigarette packets 1 quickly (i.e. achieving high hourly production rates), with high-quality folding (i.e. performing very precise folds), and in a small overall space (i.e. the packing machines 49, 56, 64, 72 and 80 are particularly compact). Furthermore, the packing machines 49, 56, 64, 72 and 80 that implement the previously described folding methods for blanks 23 and 29 have a standard layout (i.e. similar to packing machines currently on the market that manufacture standard rigid cigarette packets with a hinged lid); in consequence, the packing machines 49, 56, 64, 72 and 80 are simple and inexpensive to construct.

Following the numerous advantages of the above-described cigarette packet 1, the form of this cigarette packet 1 can be also taken integrally for the production of other types of rigid containers for tobacco articles, such as, for example, a carton of cigarette packets (in this case, the wrapped group 2 of cigarettes is replaced by a group of cigarette packets) or a packet for cigars (in this case, the wrapped group 2 of cigarettes is replaced by a group of cigars, preferably, but not necessarily, wrapped).

The invention claimed is:

1. A rigid, swing-open package (1) of tobacco articles, comprising:

a group (2) of tobacco articles;

an inner container (3) housing the group (2) of tobacco articles and having an open top end (6), a front wall (8), a rear wall (9), and two lateral walls (10);

an outer container (4) housing the inner container (3) and having a top wall (11), a bottom wall (12) opposite the top wall (11), a rear wall (14), two lateral walls (15), and an open front end (13) located between the top wall (11) and the bottom wall (12) and through which the inner container (3) moves;

a main hinge (5) connecting the inner container (3) to the outer container (4) to allow the inner container (3) to rotate between a closed position, in which the inner container (3) is inserted inside the outer container (4), and an open position, in which the inner container (3) is extracted partly from the outer container (4), through the open front end (13); and a stop member, which limits extraction of the inner container (3) from the outer container (4) and so defines a fully-open position of the inner container (3) with respect to the outer container (4);

wherein the stop member comprises a stop tab (18) having an inner panel (19) hinged at one end to the inner container (3), an outer panel (20) glued to a wall (12; 14) of the outer container (4);

the package (1) being characterized in that the stop tab (18) of the stop member has an intermediate panel (22) hinged to the inner panel (19) on one side and to the outer panel (20) on the opposite side.

2. A package (1) according to claim 1, wherein the inner panel (19) of the stop tab (18) is hinged to the inner container (3) at a bottom edge of the rear wall (9) of the inner container (3).

3. A package (1) according to claim 2, wherein the inner panel (19) of the stop tab (18) is connected by a first fold line (31) to the bottom edge of the rear wall (9) of the inner container (3).

4. A package (1) according to claim 3, wherein the inner container (3) has no bottom wall (7), and the group (2) of tobacco articles rests directly on the bottom wall (12) of the outer container (4).

5. A package (1) according to claim 3, wherein the inner container (3) has two lateral walls (10), each of which is formed by a first wing (10") forming part of a first blank (29), and by a second wing (10') forming part of a second blank (23); the first and second wing being superimposed and glued to each other.

6. A package (1) according to claim 5, wherein the front wall (8) of the inner container (3) forms part of the second blank (23), and the rear wall (9) of the inner container (3) forms part of the first blank (29).

7. A package (1) according to claim 2, wherein the inner panel (19) of the stop tab (18) is connected by a second fold line (25) to a connecting panel (32) glued to the bottom wall (7) of the inner container (3).

8. A package (1) according to claim 1, wherein the outer panel (20) of the stop tab (18) is glued to the bottom wall (12) of the outer container (4).

9. A package (1) according to claim 1, wherein the outer panel (20) of the stop tab (18) is glued to the rear wall (14) of the outer container (4).

10. A package (1) according to claim 1, wherein the stop member comprises a single central stop tab (18).

11. A package (1) according to claim 1, and comprising a retaining member, which keeps the inner container (3) in the closed position with a given retaining force, and which comprises two first retaining appendages (17) projecting upwards from the lateral walls (10) of the inner container (3) and sized to interfere mechanically with the top wall (11) of the outer container (4) when the inner container (3) is in the closed position.

12. A package (1) according to claim 1, and comprising a retaining member, which keeps the inner container (3) in the closed position with a given retaining force, and which comprises two second retaining appendages (33) projecting outwards from the rear wall (9) of the inner container (3) and sized to interfere mechanically with the lateral walls (15) of the outer container (4) when the inner container (3) is in the closed position.

13. A package (1) according to claim 1, and comprising a retaining member, which keeps the inner container (3) in the closed position with a given retaining force, and which comprises:

two retaining tabs (34) projecting upwards from and hinged to the rear wall (9) of the inner container (3); and two retaining seats (35), which are formed in the top wall (11) of the outer container (4), are located close to the rear wall (14) of the outer container (4), and negatively reproduce the shape of the retaining tabs (34).

14. A package (1) according to claim 13, wherein:

the top wall (11) of the outer container (4) is formed by a main panel (11') and an inner reinforcing panel (11") superimposed on and glued to each other; and the retaining seats (35) are defined by recesses formed in the reinforcing panel (11").

15. A package (1) according to claim 1, wherein:

the group (2) of tobacco articles is enclosed in a sealed wrapping, which at the top and rear has a tobacco article extraction opening (36) closed by an 'open & close' type sealing panel (37); and a portion of the sealing panel (37) is glued permanently to an inner surface of the top wall (11) of the outer container (4), so that movement of the inner container (3) with respect to the outer container (4) also produces an opening and closing movement of the sealing panel (37).

16. A package (1) according to claim 1, wherein the inner container (3) comprises a hinged lid (38) hinged to the inner container (3) along a lid hinge (39) to rotate, with respect to the inner container (3), between an open position and a closed position of the open top end (6) of the inner container (3).

* * * * *